US006453145B1

(12) United States Patent
Miura

(10) Patent No.: US 6,453,145 B1
(45) Date of Patent: Sep. 17, 2002

(54) FLASH-BASED FIXING APPARATUS WITH FLASH LAMP OF STABLE ILLUMINATION FOR ELECTROGRAPHIC IMAGE FORMING APPARATUS

(75) Inventor: Kuniyuki Miura, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/713,318

(22) Filed: Nov. 16, 2000

(30) Foreign Application Priority Data

Nov. 16, 1999 (JP) ..... 11-325790

(51) Int. Cl.[7] ..... G03G 15/20
(52) U.S. Cl. ..... 399/336; 219/216
(58) Field of Search ..... 399/336, 67, 69; 219/216

(56) References Cited

U.S. PATENT DOCUMENTS 5,113,223 A * 5/1992 Theodoulou et al. ... 219/216 X
5,428,434 A 6/1995 Hirao
5,521,689 A 5/1996 Miyakoshi
5,974,296 A 10/1999 Suketomo et al.

FOREIGN PATENT DOCUMENTS

JP 57-141672 A * 9/1982
JP 58-54364 A * 3/1983
JP 61-118781 A * 6/1986
JP 62-269183 A * 11/1987
JP 6-46205 * 2/1994
JP 11191483 * 7/1999

* cited by examiner

*Primary Examiner*—Quana M. Grainger
(74) *Attorney, Agent, or Firm*—Morrison & Foerster LLP

(57) ABSTRACT

A control unit controls a power supply to supply power for the illumination of a flash lamp. During illumination of the flash lamp, the current that flows through the flash lamp is kept approximately constant at a predetermined value.

20 Claims, 16 Drawing Sheets

FIG. 5A

541

| ID \ B/W | 1%OR BELOW | 1~6% | 6~15% | 15~30% | 30%OR ABOVE |
|---|---|---|---|---|---|
| 0.8 | 392J | 392J | 426J | 426J | 504J |
| 0.9 | 392J | 426J | 426J | 504J | 504J |
| 1 | 426J | 426J | 504J | 504J | 560J |
| 1.1 | 426J | 504J | 504J | 504J | 560J |
| 1.2 | 504J | 504J | 504J | 560J | 560J |

FIG. 5B

542

| Color | black | blue | green | red |
|---|---|---|---|---|
| multiple | 1 | 1.2 | 1.3 | 2 |

FIG. 14

543

| ID \ B/W | 1%OR BELOW | 1～6% | 6～15% | 15～30% | 30%OR ABOVE |
|---|---|---|---|---|---|
| 0.8 | 3.5msec | 3.5msec | 3.8msec | 3.8msec | 4.5msec |
| 0.9 | 3.5msec | 3.8msec | 3.8msec | 4.5msec | 4.5msec |
| 1 | 3.8msec | 3.8msec | 4.5msec | 4.5msec | 5msec |
| 1.1 | 3.8msec | 4.5msec | 4.5msec | 4.5msec | 5msec |
| 1.2 | 4.5msec | 4.5msec | 4.5msec | 5msec | 5msec |

FIG. 17

544

| ID \ B/W | 1%OR BELOW | 1～6% | 6～15% | 15～30% | 30%OR ABOVE |
|---|---|---|---|---|---|
| 0.8 | 250TIMES | 250TIMES | 400TIMES | 400TIMES | 550TIMES |
| 0.9 | 250TIMES | 400TIMES | 400TIMES | 550TIMES | 550TIMES |
| 1 | 400TIMES | 400TIMES | 550TIMES | 550TIMES | 700TIMES |
| 1.1 | 400TIMES | 550TIMES | 550TIMES | 700TIMES | 700TIMES |
| 1.2 | 550TIMES | 550TIMES | 700TIMES | 700TIMES | 1000TIMES |

FLASH-BASED FIXING APPARATUS WITH FLASH LAMP OF STABLE ILLUMINATION FOR ELECTROGRAPHIC IMAGE FORMING APPARATUS

This application is based on an application No. H11-325790 filed in Japan, the content of which is hereby incorporated by reference.

BACKGROUND OF THE INVENTION

1. Field of the Invention

The present invention relates to a flash-based image fixing apparatus that is used in an electrophotographic image forming apparatus such as a laser printer. In particular, the invention relates to an improvement in the supply of electricity to a flash lamp.

2. Related Art

Electrophotographic image forming apparatuses, such as laser printers, develop a latent image using toner, transfer the toner image onto a sheet of paper, and then fix the toner image using a fixing apparatus. Heated rollers are often used as this fixing apparatus, but take a long time to warm up. For this reason, increasing attention is being given to flash-based fixing apparatuses where a flash lamp is instantaneously illuminated to emit light (in particular infrared light) that supplies energy to melt the toner. Such toner includes a color agent, a binder, and the like.

FIG. 1 is a block diagram showing the circuit construction of a conventional flash-based image fixing apparatus.

As shown in FIG. 1, the flash-based fixing apparatus includes a flash lamp 200, a flash power supply unit 300, and a flash power supply control unit 500. The flash lamp 200 is filled with xenon gas. The flash power supply unit 300 supplies power to the flash lamp 200. The flash power supply control unit 500 controls the flash power supply unit 300. The flash power supply unit 300 includes an AC-DC convertor 310, a diode 320, a power-supplying film capacitor 330, a trigger circuit 340, and a choke coil 350. Of these, the diode 320 prevents reverse currents, the power-supplying film capacitor 330 has a capacitance of around 200 $\mu$F, and the choke coil 350 suppresses the discharge current.

In accordance with a charging indication given by the flash power supply control unit 500, the AC-DC convertor 310 converts an AC voltage, supplied by the commercial power supply 800 via the power supply switch 900, into a DC voltage of around 2000 V. This DC voltage is supplied to the film capacitor 330 via the diode 320.

When the voltage across the terminals of the film capacitor 330 reaches a charging stop voltage, such as 2000 V, the flash power supply control unit 500 instructs the AC-DC convertor 310 to stop the charging of the power-supplying film capacitor 330.

At the point where charging is stopped, an amount of electrostatic energy ($(0.0002*2000^2)/2=400$J) that is required to melt toner on a piece of paper across a predetermined width has accumulated in the film capacitor 330. Two thousand volts are applied across the main electrodes of the flash lamp 200 via the choke coil 350 as the charging stop voltage of the film capacitor 330. However, the flash lamp 200 does not illuminate as long as a trigger signal is not inputted.

This charging stop voltage is set at a value that exceeds the minimum voltage (such as 1200 to 1500 V) required to initiate discharge (i.e., illumination) within the flash lamp 200.

At a predetermined time following this, the flash power supply control unit 500 instructs the trigger circuit 340 to start the illumination of the flash lamp 200. The trigger circuit 340 includes a capacitor (not illustrated) for generating a trigger signal. On being instructed by the flash power supply control unit 500 to illuminate the flash lamp 200, the trigger circuit 340 discharges this capacitor and outputs the resulting voltage to the trigger electrode of the flash lamp 200 as the trigger signal. Once the trigger signal has been inputted into the trigger electrode, the electrostatic energy that has accumulated in the film capacitor 330 is released so that a discharge current flows though the main electrodes of the flash lamp 200. As a result, the flash lamp 200 momentarily illuminates due to arc discharge, for a period of between several hundred microseconds to one millisecond.

FIG. 2 shows the transition in the discharge current that flows through the flash lamp during the illumination period.

As shown in FIG. 2, the discharge current that flows through the flash lamp 200 falls from an initial peak of 300A to virtually 0A during the illumination period of around one millisecond. In more detail, during the initial stage (shown as δ1) in the illumination period, the discharge current hits a peak of 300A at roughly the same time as the trigger signal is applied and thereafter drops to 130A. In a short second stage (shown as δ2), the discharge current stabilizes at around 130A. In the third and final stage (shown as δ3), the discharge current falls from 130A to 0A.

As described above, the flash lamp 200 is repeatedly illuminated to supply energy that melts the toner on the paper, thereby fixing the toner image to the paper.

As one example, When an image is formed using black toner, the coloring agent, such as carbon black, that is located near the surface of the toner particles absorbs the light energy produced by the flash lamp 200 and converts it into heat energy. This heat energy is transmitted from the surface of the toner particles to the center. As a result, the entire toner particles melt, which fixes the toner to the paper. Here, it is preferable of the illumination of the flash lamp 200 to be prolonged so that the heat energy can be properly transmitted into the centers of the toner particles.

In a conventional flash-based fixing apparatus, the discharge current that flows through the flash lamp 200 is suppressed by the choke coil 350 to extend the illumination period to around one millisecond. However, further extension of the illumination period is difficult due to the occurrence of ringing in the circuit. Also, in the first stage of the illumination (shown as δ1 in FIG. 2), there is a sudden drop in discharge current from 300A to 130A, during which time the majority (up to around 83%) of the static charge that has accumulated in the film capacitor 330 is used up.

To extend the illumination period in a conventional flash-based fixing apparatus, it is only possible to increase the amount of static energy supplied to the flash lamp 200. This raises the peak of the current value in the initial stage of the illumination period, and makes the illumination energy produced in this initial stage extremely high. This destroys the balance between the speed at which the coloring agent is heated and the transmission of the heat to the center of the particles, resulting in sublimation of the toner particles.

Conversely, if the amount of static energy supplied to the flash lamp 200 is reduced, the peak in the discharge current will be lowered, which reduces the sublimation of toner. However, if the illumination period is shortened, less heat energy is produced, so that the toner cannot be properly fixed. With a conventional flash-based fixing apparatus, therefore, improving the adhesion of the toner to the paper results in a great loss of toner through sublimation. In addition to this loss, sublimation also generates noise and unpleasant smells, and so is a first problem for conventional apparatuses. When fixing an image made with color (i.e., non-black) toner, the coloring agent present in the toner is poor at absorbing infrared radiation, so that toners are produced so as to include an infrared absorbing agent, such as a cyanine compound that has an absorbance peak for radiation with a wavelength of 800 to 1100 nm. When the proportion of such infrared absorbing agent reaches 3 to 5% by weight, however, there is an unavoidable rise in the cost of the toner.

Also, to fix the toner using an illumination period of around one millisecond, is necessary to raise the charging stop voltage of the capacitor in the flash-based fixing-apparatus to increase the illumination energy several fold. As mentioned above, however, raising the illumination energy of the flash lamp 200 also raises the discharge current during the initial stage of the illumination period.

When images made with color toner(s) and black toner are superimposed on the same sheet of paper and both kinds of toner are fixed by the same fixing operation, the black toner absorbs an excessive amount of illumination energy that exceeds the amount absorbed when the charging stop voltage is 2000 V. This means that even more of the black toner is sublimated, leading to problems in the fixed image such as partial omissions and marks left by sublimated toner. This means that there is a second problem of an increase in the cost of producing images and the inability to fix color and black images at the same time.

In order to solve this second problem, it would conceivably be possible to raise the amount of infrared absorbing agent in the color toner to 5 to 10% by weight so that color toner could be fixed using the same amount of illumination energy as black toner. However, this would increase the cost of color toner and create another problem of the infrared absorbing agent adversely affecting the color of the color toner.

SUMMARY OF THE INVENTION

It is a first object of the present invention to provide a flash-based fixing apparatus that improves the bond between the toner and the paper while suppressing the sublimation of toner.

It is a second object of the present invention to provide a flash-based fixing apparatus that enables color toner to be fixed at the same time as black toner while suppressing the cost of color toner used.

The above first object can be achieved by a flash-based fixing apparatus for fixing toner on paper using energy provided by an illumination of a flash lamp, the flash-based fixing apparatus including: a power supply unit for supplying power to the flash lamp so that the flash lamp illuminates; and a control unit for having the power supply unit supply power to the flash lamp so that a current flowing through the flash lamp during illumination is approximately constant at a predetermined value.

With the stated construction, the control unit suppresses the amount of power to the flash lamp so as to keep the current flowing through the flash lamp roughly constant during illuminlation at a predetermined value. This evens out the rate at which light energy is produced when the flash lamp illuminates and prolongs the illumination period. While conventional apparatuses are constructed so that the discharge current is very high at the start of illumination, leading to the sublimation of toner, the present invention greatly suppresses the discharge current at the start of illumination, prolonging the illumination period and improving the fixing of the toner to the paper. This also suppresses the noise caused by sublimation.

The above second object can be achieved by a flash-based fixing apparatus for fixing toner on paper using energy provided by an illumination of a flash lamp, the flash-based fixing apparatus including: a power supply unit for supplying power to the flash lamp so that the flash lamp illuminates; and a control unit for controlling the power supply unit to supply power to the flash lamp in accordance with a condition that differs depending on a factor relating to the toner on the sheet.

With the stated construction, current is supplied to the flash lamp according to different conditions depending on factors relating to the toner. This makes it possible to change the amount of power supplied to the flash lamp depending on whether black toner or color toner is being fixed. The fixing of toner is therefore improved without increasing the cost of the color toner.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 5A shows one example of the content of the illumination energy management table stored in the ROM, while FIG. 5B shows one example of the content of the illumination energy adjustment table;

FIG. 14 shows an example of the illumination time management table shored in the ROM in the second embodiment of the present invention;

FIG. 17 shows an example of the content of the number-of-illuminations management table that is stored in the ROM in the third embodiment.

DESCRIPTION OF THE PREFERRED EMBODIMENTS

The following describe s a flash-based fixing apparatus that is an embodiment of the present invention. In the described example, the flash-based fixing apparatus is used in a laser printer.

First Embodiment

Figure 1:
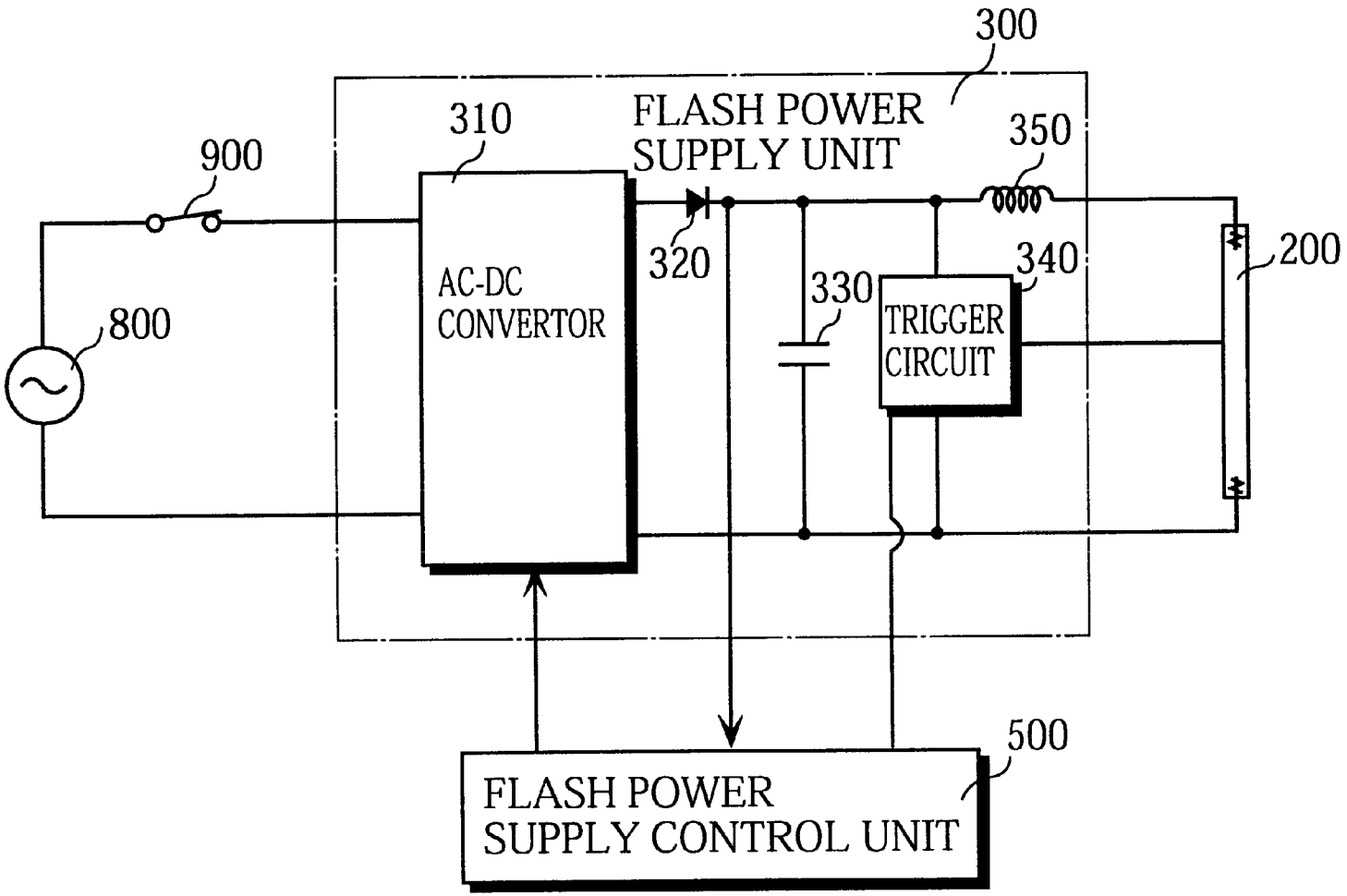
FIG. 1 is a block diagram showing the circuit construction of a conventional flash-based image fixing apparatus.
Figure 2:
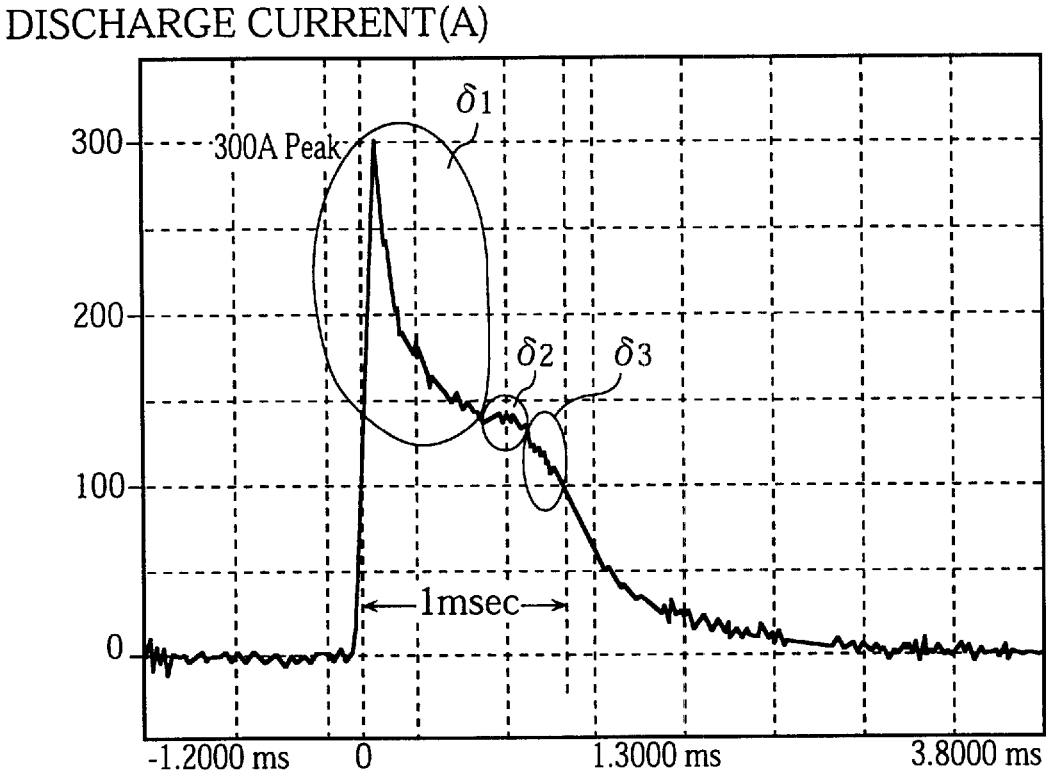
FIG. 2 shows the transition in the discharge current that flows through the flash lamp during the illumination period.
Figure 3:
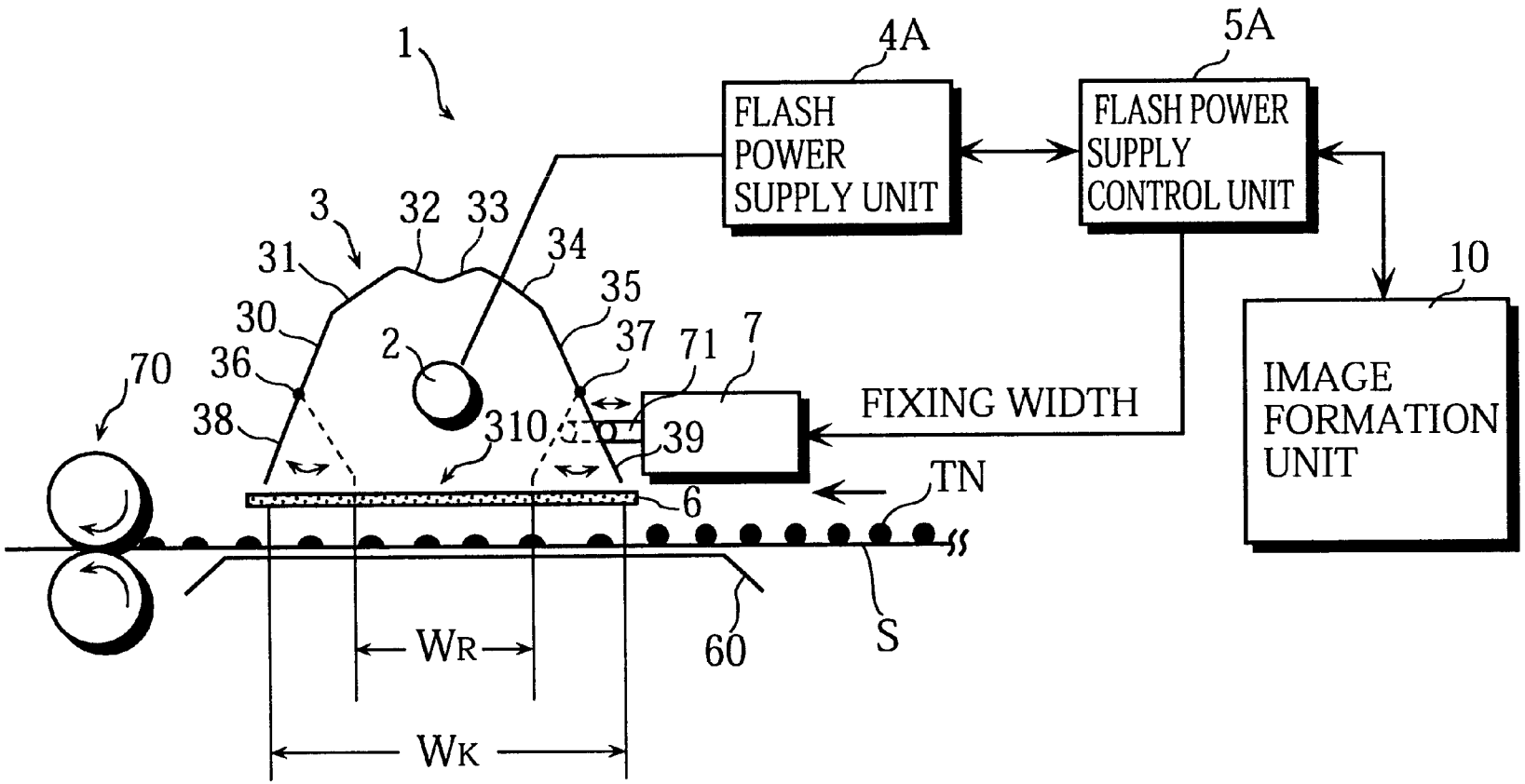
FIG. 3 shows the construction of a flash-based fixing apparatus 1 and the periphery of the flash-based fixing apparatus 1 in the first embodiment of the present invention.

FIG. 3 shows the construction of a flash-based fixing apparatus 1 of a laser printer (hereinafter simply "printer") and the periphery of the flash-based fixing apparatus 1.

In addition to the flash-based fixing apparatus 1, the printer includes an image formation unit 10 that forms an image on the paper S using toner TN.

The image formation unit 10 forms a toner image using electrophotography. This image formation unit 10 includes a photosensitive drum (not illustrated) that is rotated at a predetermined angular velocity, a scanner that has a laser beam (which is modulated in accordance with image data) scan the photosensitive drum to form a latent image, and the following components that are positioned near the photosensitive drum: a cleaner; an eraser lamp; a drum charger; a developer; and a transfer charger. Before being scanned by the laser beam, the photosensitive drum is cleaned by the cleaner to remove any remaining toner and is exposed to light produced by the eraser lamp to remove any remaining charge. Once the surface of the photosensitive drum has been evenly charged by the drum charger, the laser beam scans the surface to form a latent image. This latent image is developed by black toner (or a color toner such as blue, green or red toner) that is supplied by the developer.

Both black and color toners are mainly composed of a binder such as polyester resin, and also include a coloring agent. While the coloring agent in black toner. has a favorable absorbency of infrared radiation, the absorbency of infrared radiation is virtually zero for the coloring agents used in color toners. As a result, color toners are produced so as to include cyanine compounds, or other infrared radiation absorbing agents, that have an absorbance peak for infrared radiation with a wavelength in the range of 800 to 1100 nm. Only 1 to 2% by weight of such infrared absorbing agent is included. As a result, the increases in the cost of color toner and adverse effects on the color of such color toners can be suppressed.

In synchronization with the image forming operation, a sheet of paper S of a predetermined size (such as A3) is transported at a predetermined system-speed (such as 100 mm/s) to a transfer position located between the photosensitive drum and a transfer charger. The toner image formed on the photosensitive drum is transferred onto the sheet S at this transfer position due to charge produced by the transfer charger. Note that the image forming unit 10 controls the system speed so as to become equal to the predetermined speed based on a detection signal outputted by a rotary encoder (not illustrated) positioned on the rotation axis of a paper transport roller (not illustrated) that transports the sheet S. This detection signal is also outputted to the flash-based fixing apparatus 1 as a paper transportation signal.

The toner TN that has been transferred onto the sheet S is in an unstable state where it will soon come off if touched. Accordingly, the flash-based fixing apparatus 1 transports the sheet under a flashlight to fix the toner.

The flash-based fixing apparatus 1 includes a flash lamp 2, a reflective hood 3, a linear stepping accentuator 7, a protective glass plate 6, a flash power supply unit 4A, and a flash power supply control unit 5A. The reflective hood 3 is shaped like an inverted "U", and surrounds the flash lamp 2 so as to reflect light from the flash lamp 2 downwards. The protective glass plate 6 is provided directly below the flash lamp 2. The flash power supply unit 4A supplies power to the flash lamp 2. The flash power supply control unit 5A controls the flash power supply unit 4A and the linear stepping accentuator 7 in a coordinated manner.

The flash-based fixing apparatus 1 illuminates the flash lamp 2 with a predetermined cycle. The sheet S is transported on the guide plate 60 at the system speed. The flash lamp 2 supplies energy that melts the toner TN on the sheet S, starting with the front edge of the sheet S in the transportation direction.

The flash lamp 2 is composed of a glass tube that. is filled with xenon or other gas, and is a discharge lamp with main electrodes 21 and 22 at the ends of the glass tube (see FIG. 4) and a trigger electrode 23 (see FIG. 4) attached to the side of the tube. When a predetermined voltage is applied to the main electrodes 21 and 22 by the flash power supply unit 4A and a trigger voltage is applied to the trigger electrode 23, there is a breakdown in the insulating property of the tube and arc discharge occurs instantaneously between the main electrodes 21 and 22, producing intense infrared light for a predetermined period.

Note that in this embodiment, the distance between the main electrodes 21 and 22 of the flash lamp 2 is set at 500 mm to allow the use of A3 paper in a sideways orientation (width 420 mm) as the sheet S. The flash lamp 2 has the following characteristics. The discharge starting voltage is around 1500 V. The flash lamp 2 also has a "constant-current region". This constant-current region is a range of applied voltages within which an approximately constant current is drawn by the flash lamp 2. The highest applied voltage in the constant current region is around 840 V and the lowest applied voltage us around 600 V.

As described later, the flash power supply unit 4A applies a voltage (such as 1600 V) that exceeds the discharge start voltage only at the start of discharge to the main electrodes 21 and 22 of the flash lamp 2. As soon as discharge commences, the applied voltage drops to 800 V, which is within the constant-current region defined by the highest applied voltage of 840 V and the lowest applied voltage of 600 V. While illumination occurs, the lamp is driven within this constant-current region, with the flash power supply control unit 5A controlling the energy supplied for the illumination.

The reflective hood 3 distributes the light produced by the flash lamp 2 approximately evenly across a predetermined fixing width that lies below the flash lamp, 2. This reflective hood 3 is composed of a plurality of mirrors (six mirrors in the illustrated example) 30 to 35 that are arranged in a semicircle around the flash lamp 2, a pair of hinges 36 and 37 that are provided at the outer ends of the mirrors 30 and 35, and a pair of mirrors 38 and 39 that are attached to the hinges 36 and 37 so as to allow movement. The mirrors 38 and 39 are connected to one another by a link mechanism (not illustrated) that has the mirrors 38 and 39 swing together or apart.

The linear stepping accentuator 7 has an arm 71 that contacts the mirror 39. In accordance with fixing width information received from the flash power supply control unit 5A, the linear stepping accentuator 7 moves the arm 71 outward or inward in a straight line so as to swing the mirror 39. When the arm 71 moves outward, for example, the mirror 39 swings in a clockwise direction. Due to the presence of the linking mechanism, the mirror 38 simultaneously swings in an anticlockwise direction. This brings the bottom edges of the mirrors 38 and 39 closer together. Conversely, when the arm 71 moves inward, the bottom edges of the mirrors 38 and 39 swing further apart.

In this way, movement of, the arm 71 causes the width of the aperture 310 in the reflective hood 3 in the transportation direction of the sheet S (this width being the fixing width) to narrow to a width WR (a position shown by the broken lines in FIG. 3 with an example value being 25 mm) or to widen to a width WK (a position shown by the solid lines in FIG. 3 with an example value being 50 mm) Note that the aperture 310 of the reflective hood 3 is made 420 mm long for the case where the sheet S is A3 paper that is transported sideways.

In the present embodiment it is assumed that the black toner used requires around 1.9J/cm$^2$ of energy per unit area for fixing. In this case, if the fixing width WK=50 mm is used for fixing black toner to the sheet S, the flash lamp 2 has to provide around 400J (400≈1.9×5×42) of energy in a single illumination.

Conversely, since toners for colors apart from black can only include small amounts of infrared absorbing agents, more energy has to be used to melt the toners. As examples, around 2.28/cm$^2$ of energy per unit area is required for fixing blue toner, around 2.47/cm$^2$ of energy per unit area is required for fixing green toner, and around 3.8/cm$^2$ of energy per unit area is required for fixing red toner. Accordingly, in the present invention, the fixing width WK=50 mm is used for black toner and the fixing width WR=25 mm is used for color toners, with the illumination energy of the flash lamp 2 being the same for both black toner and color toners. By concentrating the light produced by the flash lamp 2 into the narrower fixing width of WR=25 mm, the energy density per unit area is doubled for color toners.

Note that it is also preferable to adjust the fixing width when green or blue toner is used, though no problems, such as evaporation of toner, were observed when the blue and green toners were fixed using the same energy density of 3.8J/cm$^2$ with the fixing width WR=25 mm. As a result, the present embodiment uses the fixing width WR=25 mm when the toner image on the sheet S is made of any of red, blue or green toner.

Since the sheet S is transported at a system speed of 100 mm/s by the flash-based fixing apparatus 1, when a black toner image is being fixed, the fixing width WK=50 mm is used and the flash lamp 2 is illuminated with a cycle of 0.5 seconds (i.e., the frequency is 2 Hz). When a color toner image is being fixed, the fixing width WR=25 mm is used and the flash lamp 2 is illuminated with a cycle of 0.25 seconds (i.e., the frequency is 4 Hz). This fixing width and illumination cycle are controlled by the flash power supply control unit 5A.

The toner TN on the sheet S melts due to the illumination energy provided by the flash lamp 2 and seeps between the fibers of the sheet S, thereby fixing the toner TN. Once the toner TN has been fixed, the sheet S is transported along the guide plate 6 by the discharge roller 70 and is discharged onto a discharge tray (not illustrated).

The following describes the construction of (i) the flash power supply unit 4A that supplies power to the flash lamp 2 and (ii) the flash power supply control unit 5A that controls the flash power supply unit 4A and the linear stepping accentuator 7.

Figure 4:
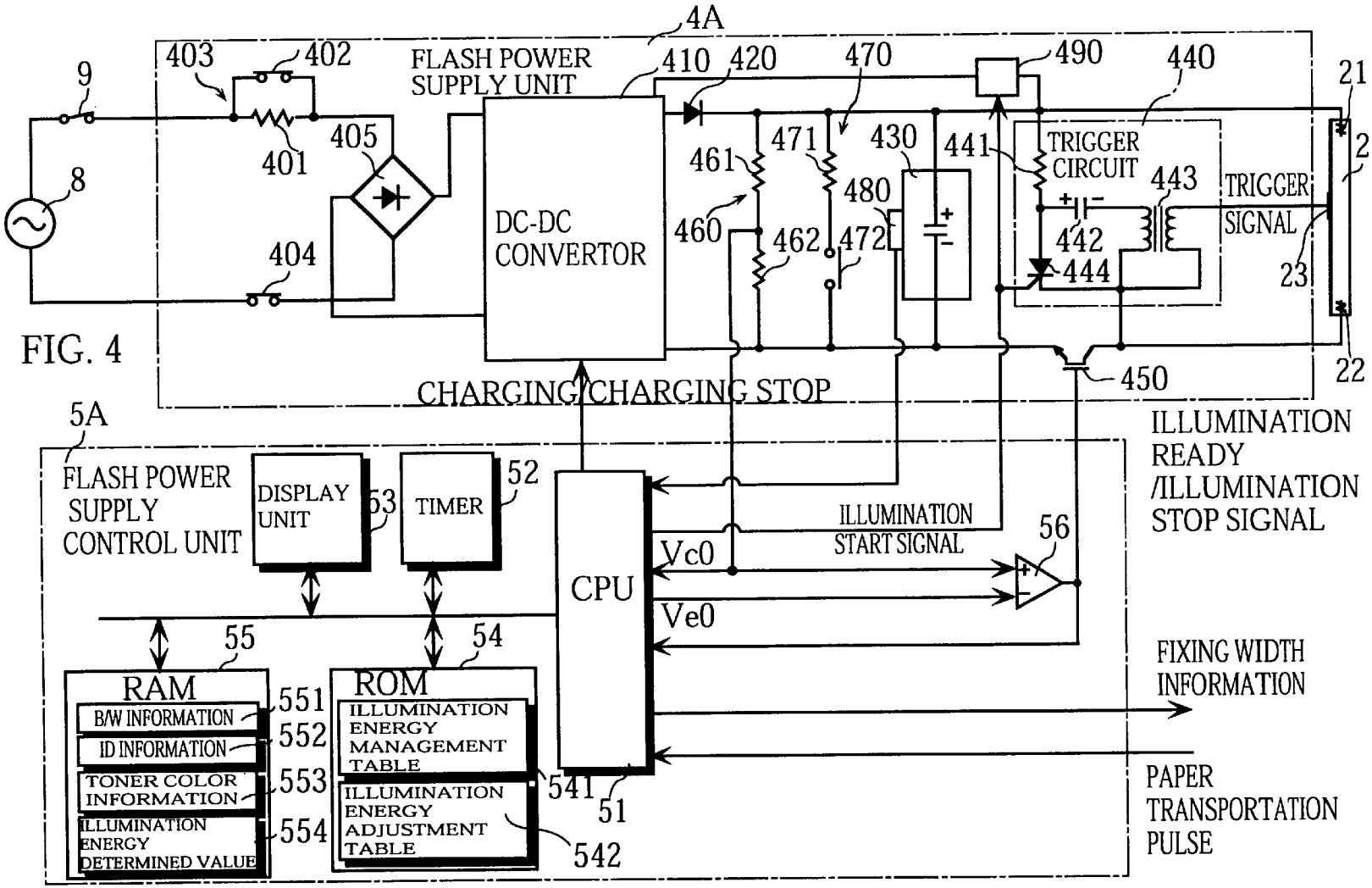
FIG. 4 is a block diagram showing the circuit construction of the flash power supply unit and the flash power supply control unit of FIG. 3, as well as the periphery.

FIG. 4 is a block diagram showing the circuit construction of the flash power supply unit 4A, the flash power supply control unit 5A, and the periphery.

As main components, the flash power supply unit 4A includes a bridge diode 405, a DC-DC convertor 410, a diode 420, a main bank capacitor 430, a trigger circuit 440, and an IGBT (Insulated Gate Bipolar Transistor) 450.

The bridge diode 405 rectifies an alternating current (for example; 200 V and 15A) that is supplied by the commercial power supply unit 8 via the power switch 9.

Note that the power supplying circuit located between the power switch 9 and the bridge diode.405 includes a current suppressing resistor 401 that has a high resistance, a release switch 402 that is connected to the current suppressing resistor 401 in parallel, and an inrush current suppressing circuit 403. The inrush current suppressing circuit 403 stops the flow of inrush currents that exceed a predetermined value to the bridge diode 405 or DC-DC convertor 410 before sufficient charge has accumulated in the main bank capacitor 430. The inrush current suppressing circuit 403 turns off the release switch 402 for a predetermined period and so has the current suppressing resistor 401 suppress the flow of currents. When a certain amount of charge has accumulated and a current that is equal to the predetermined value or above no longer flows, the inrush current suppressing circuit 403 sets the release switch 402 at ON. Note that the release switch 402 is switched ON and OFF by the flash power supply control unit 5A.

A release switch 404 is provided in the power supply circuit between the commercial power supply unit 8 and the bridge diode 405. This release switch 404 is switched ON and OFF by the flash power supply control unit 5A. Even when the power switch 9 has not been switched OFF, the supply of power to the bridge diode 405 can be automatically stopped using this release switch 404.

As one example, the DC-DC convertor 410 is a switching power supply that improves the power factor with a phase difference of almost zero with the current and voltage that are outputted from the bridge diode 405.

Based on a charging instruction received from the flash power supply control unit 5A, the DC-DC convertor 410 performs a switching operation for the rectified current to convert it into a predetermined direct voltage (such as 800 V). The DC-DC convertor 410 applies this 800 V DC voltage, via the diode 420, to the main bank capacitor 430 and charges the main bank capacitor 430 until the voltage Vc across the terminals of the main bank capacitor 430 reaches a charging stop voltage Vcs of 800 V.

The DC-DC convertor 410 can also stop the charging of the main bank capacitor 430 based on a charging stop indication received from the flash power supply control unit 5A.

The diode 420 stops the charge that has accumulated in the main bank capacitor 430 from flowing back toward the DC-DC convertor 410.

The main bank capacitor 430 is composed of two serially connected electrolytic capacitors that have a withstand voltage of around 450 V. The main bank capacitor 430 has a total capacitance C (for example, C=6250 $\mu$F) that is much larger than the capacitance (around 200 $\mu$F) of the capacitor in a conventional circuit, and so is capable of accumulating an amount of static energy ($E=C^*Vcs^2/2=2000J$) that exceeds the amount required (such as 400J) for one illumination of the flash lamp 2.

Static energy is accumulated in the main bank capacitor 430 in advance for the following reason. If the flash lamp 2 were powered directly from the DC-DC convertor 410, the limit on the amount of power that can be supplied by the commercial power supply unit 8 would mean that the. DC-DC convertor 410 would not be able to supply enough power. As a result, the energy required to illuminate the flash lamp 2 is accumulated in advance in the main bank capacitor 430 which supplies a suitable amount of energy for one illumination at a time to the flash lamp 2.

The reason the main bank capacitor 430 is made to accumulate more than enough energy for one illumination of the flash lamp 2 is as follows. If enough charge is left in the main bank capacitor 430 after the energy for one illumination of the flash lamp 2 has been supplied, this supplying of energy is not accompanied by a significant drop in the voltage Vc across the terminals of the main bank capacitor 430.

If the energy used in one illumination of the flash lamp 2 is set as E, the capacitance of the main bank capacitor 430 is set as C, the voltage across the terminals of the main bank capacitor 430 when charging is stopped (hereinafter, "charging stop voltage") is set as Vcs, the voltage across the terminals of main bank capacitor 430 when discharge by the flash lamp 2 ends (hereinafter, "discharging stop voltage") is set as Vce, the following equation can be written.

$$E=\{C^*(Vcs^2-Vce^2)\}/2 \quad (1)$$

Substituting the values E=400[J], C=0.00625[F], and Vcs=800 [V] into the above Equation (1) gives the value of the discharging stop voltage Vce at approximately 716 V. As a result, the drop in voltage across the terminals of the main bank capacitor 430 is 84 V. Since the charging stop voltage Vcs of 800 V and the discharging stop voltage Vce of 716 V are within the constant-current region of the flash lamp 2, the discharge current is constant at around 120A if the impedance of the flash lamp 2 is constant. Accordingly, if enough static charge is accumulated in the main bank capacitor 430, the discharge current during the illumination of the flash lamp 2 can be kept roughly constant, which evens out the current waveform during the illumination period.

If, as described above, there is little variation in the voltage, cheap electrolytic capacitors can be used in place of the expensive film capacitor that was conventionally used.

Note that a voltage detection circuit 460 including the voltage dividing resistors 461 and 462 (which have high resistances) is provided across both terminals of the main bank capacitor 430. This voltage detection circuit 460 detects the voltage Vc across the terminals of the main bank capacitor 430.

A temperature detector 480 such as a thermistor is attached to the main bank capacitor 430 to detect the temperature of the main bank capacitor 430.

A charge releasing circuit 470, including a resistor 471 with a high resistance and a release switch 472 that is normally OFF, is also provided across the terminals of the main bank capacitor 430.

This charge releasing circuit 470 releases the charge that accumulates in the main bank capacitor 430 and is provided to avoid danger during inspections and maintenance. When the power switch 9 is OFF, the release switch 472 is turned ON by the flash power supply control unit 5A and has the charge that has accumulated in the main bank capacitor 430 flow via the resistor 471 and the release switch 472 to an earth line to discharge the main bank capacitor 430.

The IGBT 450 has construction where an SCR (short for Silicon Controlled Rectifier and a registered trademark) with pnpn junctions and a MOSFET are combined. This IGBT 450 operates at high voltage and high current, and is a three-terminal MOS combined semiconductor switching element that is capable of switching ON and OFF at very short intervals. This IGBT 450 is turned ON by an [H] signal (the illumination ready signal) outputted by the flash power supply control unit 5A. As a result, the voltage Vc across the terminals of the main bank capacitor 430 is applied across the main terminals 21 and 22 of the flash lamp 2.

The IGBT 450 is turned off by an [L] signal (illumination stop signal) outputted by the flash power supply control unit 5A. As a result, the flash lamp 2 is electrically cut off from the main bank capacitor 430, so that the discharge current does not flow through the main electrodes 21 and 22 of the flash lamp 2 and the flash lamp 2 is extinguished.

The trigger circuit 440 applies a trigger signal to the trigger electrode 23 of the flash lamp 2 based on the illumination start signal outputted by the flash power supply control unit 5A. The trigger circuit 440 includes a resistor 441 with a high resistance, a capacitor 442 that is charged via the resistor 441, a trigger transformer 443 that has primary and secondary coils, and an SCR 444.

When the main bank capacitor 430 is being charged, the capacitor 442 is charged via the resistor 441 until the voltage Vc across the terminals of the main bank capacitor 430 reaches the charging stop voltage Vcs (i.e., 800 V). The charge that has accumulated in the capacitor 442 passes though the SCR 444 when an illumination start signal is received from the flash power supply control unit 5A, and flows though the primary coil of the trigger transformer 443 all at once. As a result, a large current is generated in the secondary coil, with this generated current being supplied to the trigger electrode 23 of the flash lamp 2.

When a large current is applied to the trigger electrode 23; the xenon gas in the flash lamp 2 is activated, making it easier for current to flow between the main electrodes 21 and 22. Note that the IGBT 450 was switched ON before the SCR 444 is put into a conductive state. As a result, the voltage of the main bank capacitor 430 is being applied across the main electrodes 21 and 22 of the flash lamp 2 at this point, so that the flash lamp 2 illuminates.

Note that the resistance of the charging resistor 441 is set so that holding current is too small to keep the SCR 444 turned ON. Accordingly, once the charge accumulated in the capacitor 442 has been discharged, the SCR 444 is turned OFF and the capacitor 442 can be charged in readiness for the next illumination of the flash lamp 2.

The voltage applied to the flash lamp 2 is 800 V, but when the discharge start voltage of the flash lamp 2 exceeds the charged voltage of the main bank capacitor 430, the voltage applied to the main electrodes 21 and 22 of the flash lamp 2 can be momentarily raised by an additional circuit 490 to commence the discharge in the flash lamp 2.

The current supplying ability of this additional circuit 490 is very low compared with the main bank capacitor 430 so that while the voltage applied to the flash lamp 2 is momentarily raised and discharge commences, shortly afterward the supply of current will be cut off. As a result, the voltage applied to the flash lamp 2 will fall to the voltage across the main bank capacitor 430, thereby suppressing the peak current and peak width at the start of discharge in the flash lamp 2.

The following describes the construction of the flash power supply control unit 5A.

The flash power supply control unit SA is composed of a CPU 51, a timer 52 that is connected to the CPU 51, a display unit 53, a ROM 54, a RAM 55, and a comparator 56.

The timer 52 measures a variety of periods in accordance with indications from the CPU 51.

The display unit 53 displays a variety of information to the user in accordance with indications from the CPU 51.

The ROM 54 stores programs for controlling the illumination of the flash lamp 2, programs for investigating whether there has been deterioration in the flash lamp 2, the main bank capacitor 430, or other components, and an illumination energy management table 541 and illumination energy adjustment table 542 for managing the illumination energy supplied to the flash lamp 2. These tables are stored in advance.

FIG. 5A shows one example of the content of the illumination energy management table 541 stored in the ROM 54.

The illumination energy management table 541 shows the relationship between (i) coverage information (hereinafter "B/W information") relating to ratio of the number of pixels to which toner is attached to the total number of pixels forming the entire image on a single sheet S, (ii) image density information (hereinafter "ID information") showing the average density of the pixels where toner is applied, and (iii) the amount of illumination energy to be supplied to the flash lamp 2 for one illumination.

The illumination energy management table 541 corresponds to when black toner is used. When, for example, the B/W ratio is 1 to 6% and the ID is 0.8, the illumination energy management table 541 shows that the flash lamp 2 should be illuminated using 392J of energy to fix the black toner. FIG. 5B shows one example of the content of the illumination energy adjustment table 542.

The illumination energy adjustment table 542 shows an adjustment for the amount of illumination energy supplied to the flash lamp 2 when the toner is blue, green, or red as a multiple with the index value "1" set for the case where the toner is black.

When, for example, the B/W ratio is 1 to 6%, the ID is 0.8, and the image is formed with red toner, the illumination energy management table 541 and illumination energy adjustment table 542 show that the flash lamp 2 should be illuminated using 2*392J=784J of energy to fix the red toner. In the present embodiment, the fixing width is reduced when fixing color toner, so that the energy density per unit area is doubled. When the apparatus determines the fixing width so that it can inform the linear stepping accentuator 7 or determines the illumination frequency of the flash lamp 2, the apparatus refers to the illumination energy adjustment table 542 and finds the adjustment to the fixing width and the adjustment to the illumination frequency.

Returning to FIG. 4, the RAM 55 supplies a work area for executing the programs mentioned above, and stores the B/W information 551, the ID information 552, and the toner color information 553. This data is received from the image forming unit 10. The RAM 55 also stores the illumination energy determined value 554. This illumination energy determined value 554 is stored having been determined by the CPU 51 based on the B/W information 551, the ID information 552, the toner color information 553, the illumination energy management table 541, and the illumination energy adjustment table 542.

This illumination energy determined value 554 is found as follows.

As one example, suppose that an image is formed with black toner and that the B/W ratio is 1 to 6% and the ID is 0.8. In this case, the energy to be used for one illumination of the flash lamp 2 is 392J, and the illumination energy determined value 554 is 392J.

Figure 6:
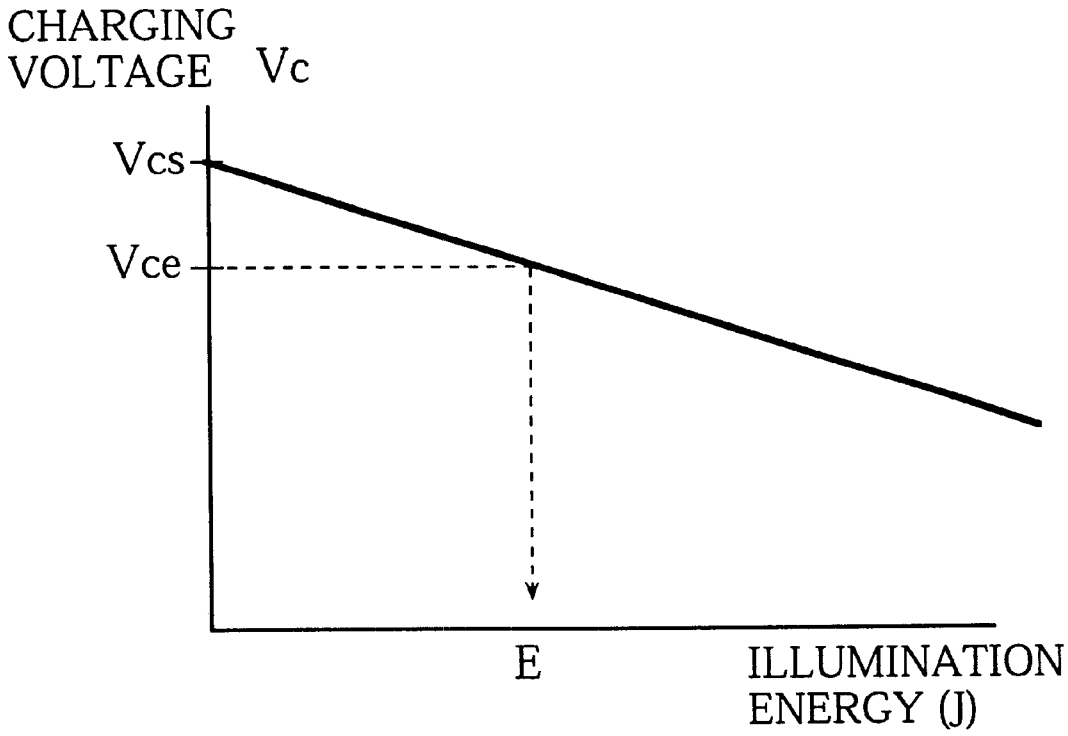
FIG. 6 shows the relationship between the voltage Vc across the terminals of the main bank capacitor and the illumination energy.

The illumination energy E and voltage Vc across the terminals of the main bank capacitor 430 are related as shown in Equation (1). As shown by the equation, there is a larger drop in the voltage Vc from the charging stop voltage Vcs as the illumination energy E increases. This is shown in FIG. 6.

As a result, if the drop in the voltage Vc across the main bank capacitor 430 from the charging stop voltage Vcs is monitored and the flash lamp 2 is extinguished when the voltage Vc drops to the discharging stop voltage Vce, changes in the impedance of the flash lamp 2 that accompany temperature characteristics or prolonged use can be managed so as to keep the energy used by the flash lamp 2 constant.

For this reason, the present embodiment finds from Equation (1) that the discharging stop voltage Vce is approximately equal to 717 V. When the comparator 56 finds that the voltage Vc across the terminals of the main bank capacitor 430 has dropped to the discharging stop voltage Vce, the IGBT 450 is switched OFF to cut off the discharge current, extinguish the flash lamp 2 and so manage the amount of illumination energy used in the illumination.

The voltage Vc0 produced when the voltage Vc across the terminals of the main bank capacitor 430 is divided by the voltage detection circuit 460 is inputted into the non-inverted input terminal of the comparator 56. A voltage Ve0 is inputted into the inverted input terminal by the CPU 51. This voltage Ve0 corresponds the voltage that would be inputted if the discharging stop voltage Vce (here, 717 V) were divided by the voltage detection circuit 460.

The comparator 56 exhibits hysteris is with a lower trip point at the voltage Ve0 and an upper trip point at a voltage Vcs0 that is voltage near the charging stop voltage Vcs. The comparator 56 compares the lower trip point, upper trip point, and voltage Vc0 inputted from the voltage detection circuit 460.

In more detail, when the voltage Vc across the terminals of the main bank capacitor 430 falls, the comparator 56 compares the voltage Ve0 that is the lower trip point with the voltage Vc0, and, when the voltage Vc0 is below the voltage Ve0, outputs an L signal (illumination stop signal) to switch OFF the IGBT 450. Conversely, when the voltage Vc across the terminals of the main bank capacitor 430 rises to a value near the voltage Vcs0 used as the upper trip point, the comparator 56 outputs an H signal (illumination ready signal) to switch ON the IGBT 450. Since the IGBT 450 can be switched from OFF to ON in around 100 milliseconds, the gas inside the flash lamp 2 is activated only for this period. As a result, even if the IGBT 450 is switched ON, the flash lamp 2 will not illuminate due to a follow current so long as another trigger signal is not applied to the trigger electrode 23.

The CPU 51 monitors the voltage Vc0 outputted by the voltage detection circuit 460, the temperature detected by the temperature detector 480, and the output of the. comparator 56. As necessary, the CPU 51 also switches the release switches 402, 404, and 472 ON and OFF.

In accordance with the illumination energy management table 541 and illumination energy adjustment table 542 described above, the CPU 51 calculates the illumination energy determined value 554 and outputs a voltage Ve0 representing this illumination energy determined value 554 to the comparator 56. The CPU 51 also outputs the fixing width information to the linear stepping accentuator 7. At a predetermined timing, the CPU 51 instructs the DC-DC convertor 410 to start/stop charging, as well as outputting an illumination start signal to the trigger circuit 440. The CPU 51 coordinates all these processes so that the fixing procedure proceeds smoothly.

The following describes the fixing procedure executed by the CPU 51, with reference to a flowchart.

The CPU 51 periodically communicates with a CPU of the image forming unit 10 by performing a main routine that is not illustrated. During this main routine, the CPU 51 receives the B/W information 551, the ID information 552, and the toner color information 553 from the CPU of the image forming unit 10 whenever image formation is performed on one sheet of paper and stores the received information in the RAM 55.

Figure 7:
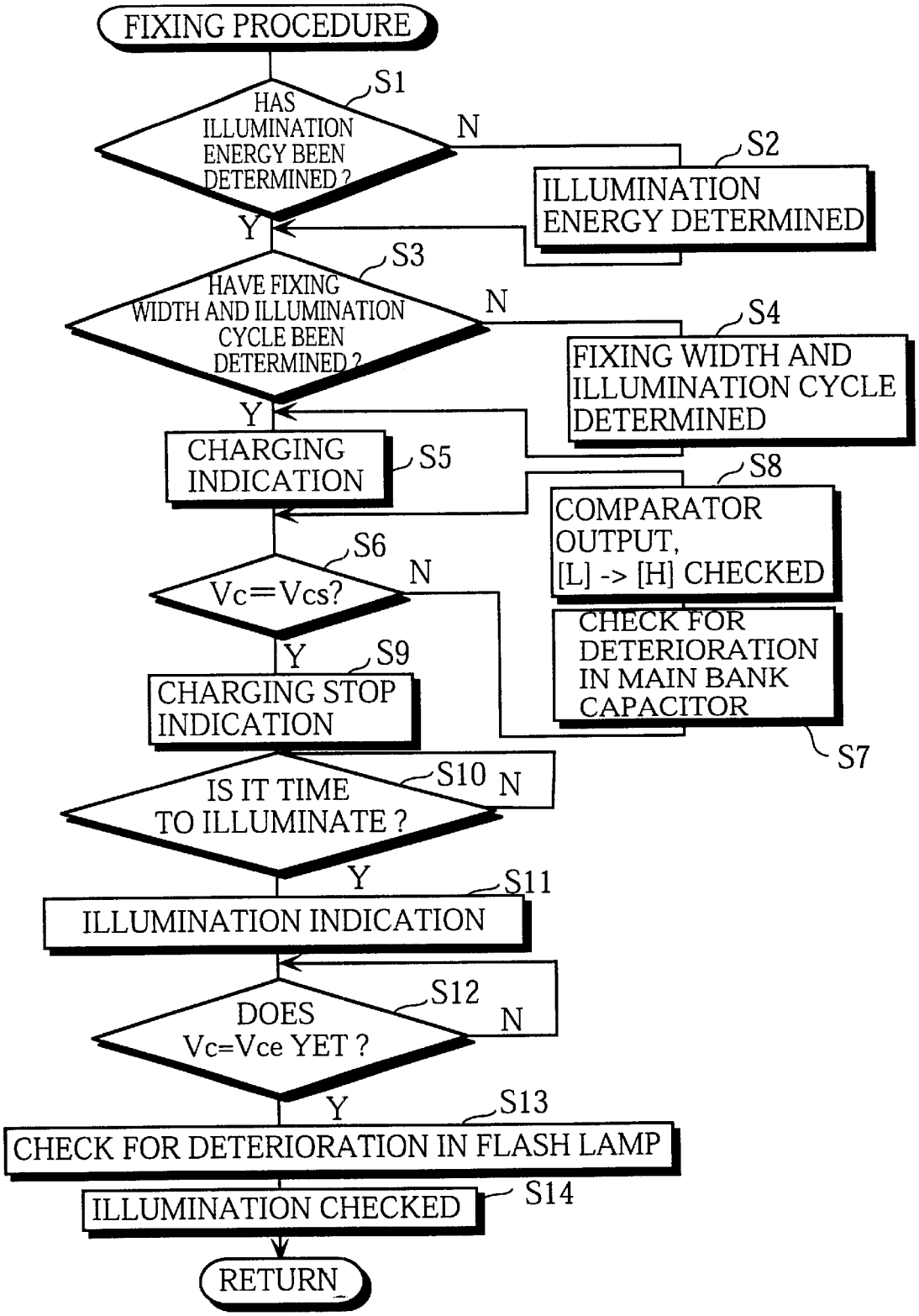
FIG. 7 is a flowchart showing the fixing procedure executed by the CPU.

FIG. 7 is a flowchart showing the fixing procedure executed by the CPU 51.

The fixing procedure starts with the CPU 51 judging, based on the B/W information 551 and ID information 552 stored in the RAM 55, whether the illumination energy for one illumination of the flash lamp 2 has been determined (step S1). If not (step S1:No), the CPU 51 determines the illumination energy (step S2) and proceeds to step S3. If that illumination energy has already been determined (step S1:Yes), the CPU 51 skips step S2 and executes step S3.

In step S2, the CPU 51 reads the B/W information 551 and ID information 552 for the sheet S on which toner is to be fixed from the RAM 55. From this data and the illumination energy management table 541 (shown in FIG. 5A), the CPU 51 finds the desired illumination energy, and obtains the discharging stop voltage Vce at a point when this illumination energy has been supplied from Equation (1). After this, the CPU 51 calculates the voltage Ve0 that corresponds to the voltage outputted by the voltage detection circuit 460 if the obtained discharging stop voltage Vce is divided, and sets this voltage Ve0 in the comparator 56. In more detail, when the B/W ratio is 1 to 6%, the ID is 0.8 and black toner is being fixed, E=392J, so that the discharging stop voltage Vce is approximately 717 V. As a result, the CPU 51 outputs a voltage equal to the case where 717 V is divided by the voltage detection circuit 460 to the comparator 56 as the voltage Ve0.

In step S3, the CPU 51 judges, based on the toner color information 553 stored in the RAM 55, whether the adjustment (the fixing width and illumination cycle) to the illumination energy that should be used in one illumination of the flash lamp 2 has been determined. If it has not been determined (step S3:No), the CPU 51 determines the adjustment (step S4) and proceeds to step S5. If the adjustment has been determined (step S3:Yes), the CPU 51 skips step S4 and proceeds to step S5.

The determination of the adjustment (the fixing width and illumination cycle) in step S4 sets the fixing width at WK=50 mm and the illumination cycle of the flash lamp 2 at 0.5s (2 Hz) when black toner is used, or the fixing width at WR=25 mm and the illumination cycle of the flash lamp 2 at 0.25s (4 Hz) when color toner is used.

In step S5, the CPU 51 outputs a charging indication to the DC-DC convertor 410. In addition to this charging indication, the DC-DC convertor 410 receives the supply of a rectified current from the bridge diode 405 and charges the main bank capacitor 430. As a result, the voltage Vc across the terminals of the main bank capacitor 430 rises. At this point, the capacitor 442 of the trigger circuit 440 is also charged.

After outputting a charging indication, the CPU 51 monitors the output of the voltage detection circuit 460 and judges whether the voltage Vc across the terminals of the main bank capacitor 430 has reached the charging stop voltage Vcs (Vcs=800 V) (step S6). If the voltage Vc has not reached the voltage Vcs (step S6:No), the CPU 51 executes the deterioration checking procedure for the main bank capacitor 430 (step S7).

Figure 8:
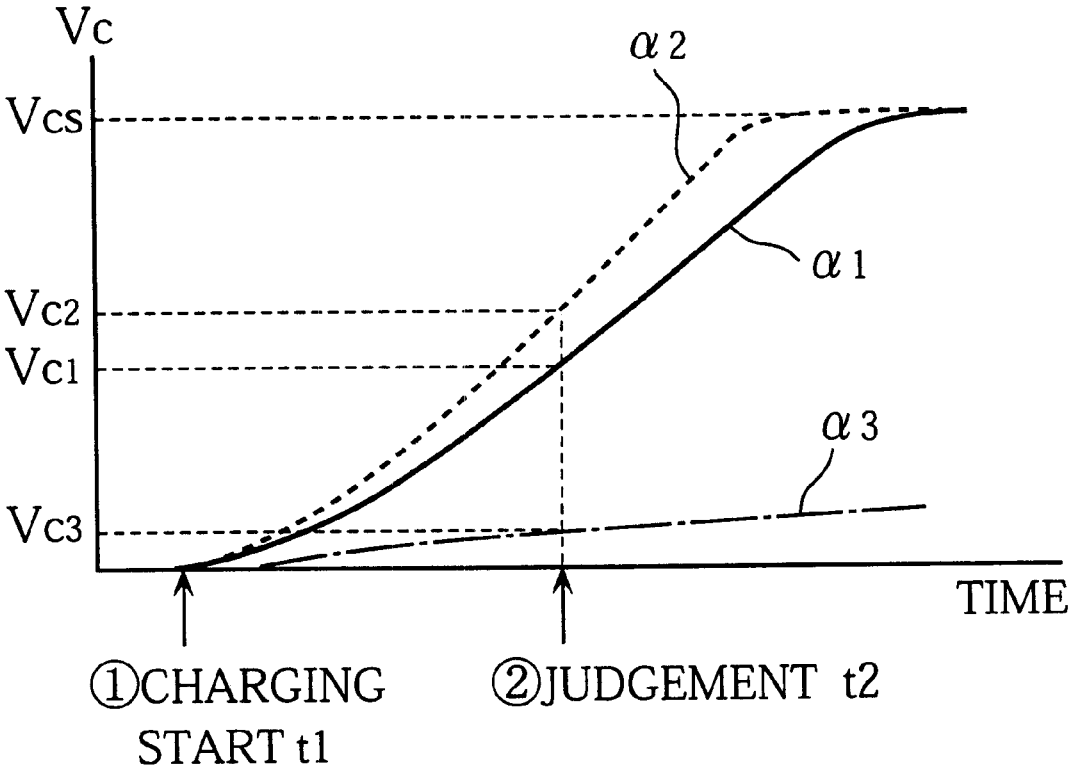
FIG. 8 shows the changes in the voltage Vc across the terminals of the main bank capacitor during charging of the main bank capacitor.

When the main bank capacitor 430 is charged, if the capacity of the main bank capacitor 430 is normal, the voltage Vc across the terminals of the main bank capacitor 430 will rise as shown by the solid line $\alpha$1 in FIG. 8. If the main bank capacitor 430 has deteriorated and its capacity has fallen, the voltage Vc across the terminals of the main bank capacitor 430 will quickly rise as shown by the broken line $\alpha$2 in FIG. 8.

When there is a defect in the charging mechanism such as in the DC-DC convertor 410, or when the main bank capacitor 430 is shorted out, the voltage Vc across the terminals of the main bank capacitor 430 will slowly rise, as shown by the dot-dash line $\alpha$3 in FIG. 8.

At a time t2 where a predetermined period has passed following the charging start time t1, the CPU 51 monitors the voltage Vc across the terminals of the main bank capacitor 430. If this voltage Vc is equal to a predetermined voltage Vc1, the CPU 51 judges that the main bank capacitor 430 is normal and proceeds to step S8.

Conversely, when the voltage Vc is a higher voltage Vc2 than the predetermined voltage Vc1, the CPU 51 judges that the capacity of the main bank capacitor 430 has decreased and ends the charging procedure. The CPU 51 also has the display unit 53 inform the user of the deterioration in the main bank capacitor 430.

When the voltage Vc is a lower voltage Vc3 than the predetermined voltage Vc1, the CPU 51 judges that the main bank capacitor 430 has shorted out or that there is a problem with the charging mechanism. Accordingly, the CPU 51 ends the charging procedure and has the display unit 53 inform the user that there is a problem.

When the main bank capacitor 430 has deteriorated, the leakage current increases, so that the temperature of the main bank capacitor 430 rises. Accordingly, the CPU 51 monitors the temperature of the main bank capacitor 430 using the temperature detector 480. When the detected temperature rises above a predetermined temperature, the CPU 51 judges that the main bank capacitor 430 has deteriorated and ends the charging procedure. The CPU 51 also has the display unit 53 inform the user of the deterioration in the main bank capacitor 430. Note that when the temperature of the main bank capacitor 430 rises, the main bank capacitor 430 will expand due to this rise in temperature. As a result, a pressure sensor can be mounted on the main bank capacitor 430 and expansion in the main bank capacitor 430 can be detected by this pressure sensor.

If the main bank capacitor 430 is normal, the CPU 51 executes step S8. In step S8, the CPU 51 monitors the output of the comparator 56 and on finding that the output level of the comparator 56 has changed from [L] to [H], returns to step S6 where the CPU 51 waits until the voltage Vc=Vcs. Note that the comparator 56 changes its output level from [L] to [H] just before the voltage Vc across the terminals of the main bank capacitor 430 reaches the charging stop voltage Vcs. This change in output level results in the IGBT 450 being switched ON.

When the voltage Vc across the terminals of the main bank capacitor 430 rises to become equal to the charging stop voltage Vcs=800 V (step S6:Yes), the CPU 51 instructs the DC-DC convertor 410 to stop charging the main bank capacitor 430 (step S9). As a result, the DC-DC convertor 410 stops charging the main bank capacitor 430.

After having the charging stopped, the CPU 51 monitors the time counted by the timer 52 and waits for the illumination timing shown by the illumination cycle (step S10). When it is time to illuminate the flash lamp 2 (timing t3), the CPU 51 outputs an illumination start signal to the SCR 444 in the trigger circuit 440 (step S11). As a result, the SCR 444 passes a current so that the trigger signal is inputted into the trigger electrode 23 of the flash lamp 2. As a result, the flash lamp 2 illuminates and receives the static energy that has accumulated in the main bank capacitor 430 to produce an amount of light energy that is proportionate to the approximately constant discharge current.

After outputting the illumination start signal, the CPU 51 refers to the time counted by the timer 52 and waits for the voltage Vc across the terminals of the main bank capacitor 430 to become equal to the discharge stop voltage Vce that was obtained in step S2 (step S12). At this point, the CPU 51 executes the deterioration checking procedure for the flash lamp 2 (step S13).

Figure 9:
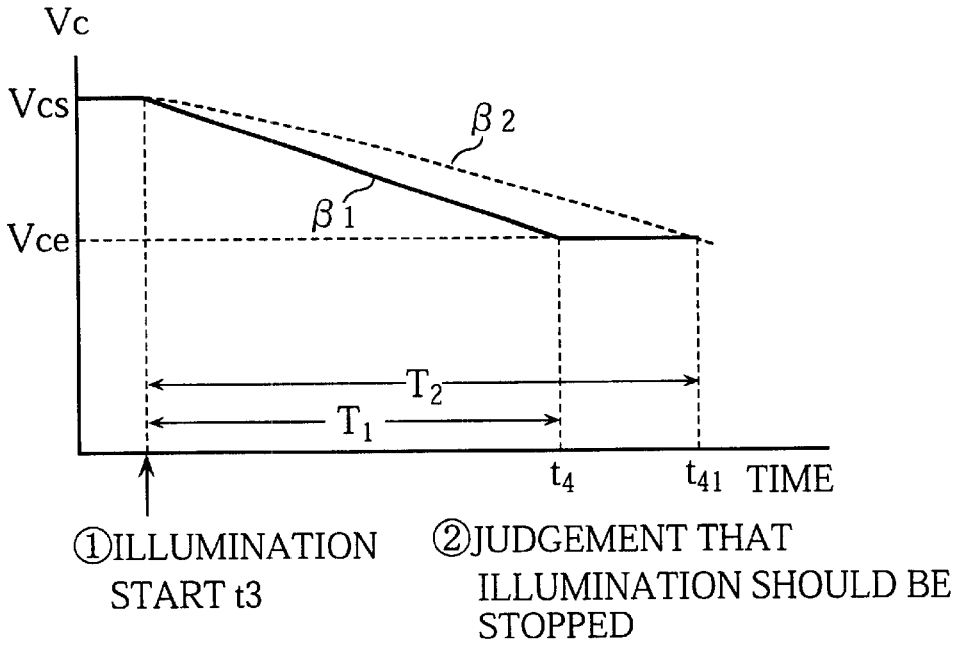
FIG. 9 shows how deterioration in the flash lamp can be detected based on a period of time.

When the flash lamp 2 has been illuminated, if the impedance of the flash lamp 2 is at a low (normal) level, the voltage Vc across the terminals of the main bank capacitor 430 will drop as shown by the solid line β1 in FIG. 9 and will become equal to the discharge stop voltage Vce at timing t4.

On the other hand, if the flash lamp 2 has deteriorated and the impedance has risen, the voltage Vc across the terminals of the main bank capacitor 430 will fall slowly as shown by the broken line β2 in FIG. 9. As a result, the voltage Vc only becomes equal to the discharge stop voltage Vce at timing t41 which comes after t4.

When the voltage Vc across the terminals of the main bank capacitor 430 becomes equal to the discharge stop voltage Vce, the output level of the comparator 56 changes from [H] to [L], and the IGBT 450 is switched OFF, resulting in the flash lamp 2 being extinguished. When the flash lamp 2 has deteriorated, however, more time is taken before the flash lamp 2 is extinguished, so that there is the risk that the illumination energy cannot be managed properly.

As a result, the CPU 51 monitors the time from the discharge start time t3 to the point where the voltage Vc across the terminals of the main bank capacitor 430 becomes equal to the discharging stop voltage Vce, which is to say, the time taken to dissipate the illumination energy. When this time is equal to a predetermined time T1, the CPU 51 judges that the flash lamp 2 is normal and proceeds to step S14.

On the other hand, when the time taken is T2 and exceeds the predetermined time T1, the CPU 51 judges that the flash lamp 2 has deteriorated and ends the fixing procedure. The CPU 51 also has the display unit 53 inform the user of the deterioration in the flash lamp 2.

Note while that the deterioration checking procedure shown in FIG. 9 checks for deterioration in the flash lamp 2 by measuring the time needed to dissipate the determined amount of illumination energy, other methods may be used.

Figure 10:
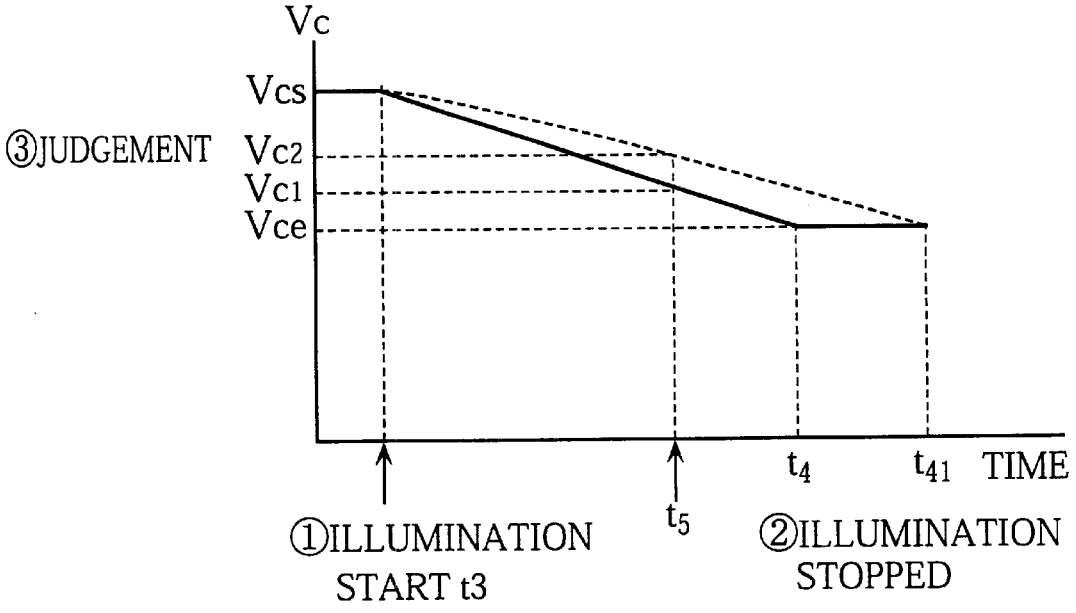
FIG. 10 shows how deterioration in the flash lamp can be detected based on a voltage.

One example is shown in FIG. 10. In this example, the voltage Vc across the terminals of the main bank capacitor 430 is monitored at time t5 before the voltage Vc reaches the predetermined voltage Vce. If the voltage Vc at the time t5 is equal to a predetermined voltage Vc1, the CPU 51 judges that the flash lamp 2 is normal. If the voltage Vc is equal to a voltage Vc2 that exceeds the predetermined voltage Vc1, the CPU 51 may judge that the flash lamp 2 has deteriorated. This deterioration checking procedure may be repeated every time step S12 is performed.

After completing the deterioration checking procedure for the flash lamp 2, the CPU 51 executes the illumination checking procedure (step S14) for the flash lamp 2.

Figure 11:
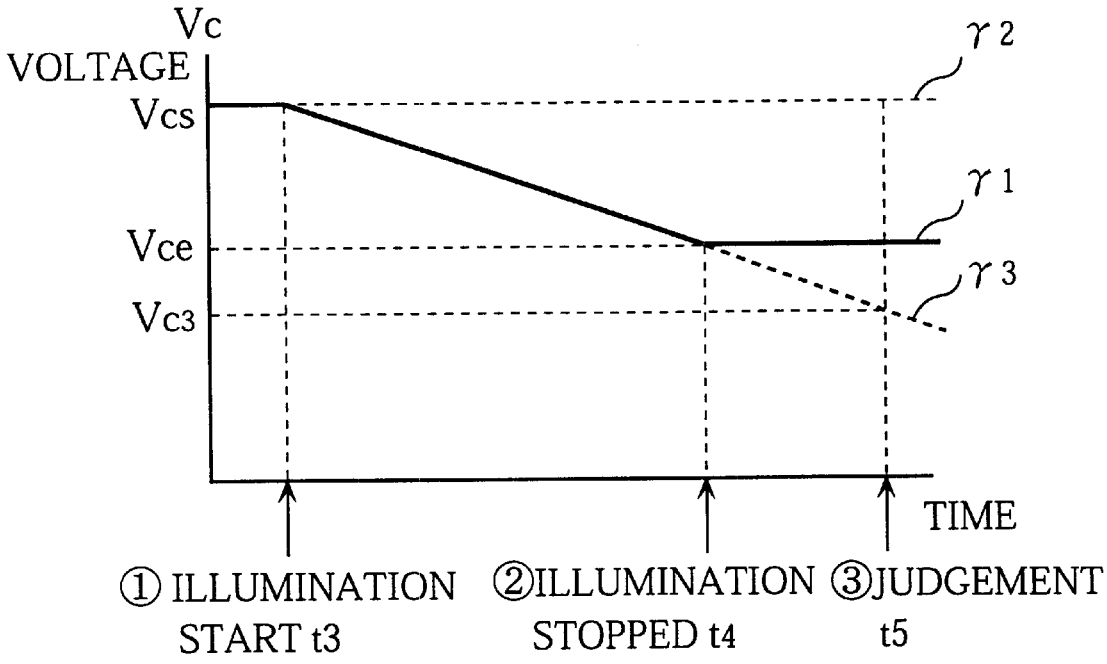
FIG. 11 shows a procedure for checking whether the illumination energy produced by the flash lamp during illumination is proper.

The following describes the illumination checking procedure of step .S14 with reference to FIG. 11.

FIG. 11 shows the changes in the voltage Vc across the terminals of the main bank capacitor 430 during the illumination period of the flash lamp 2. In FIG. 11, the time t3 represents the illumination start time at which the illumination start signal is outputted to the trigger circuit 440, the time t4 represents the time at which the comparator 56 outputs the illumination stop signal [L], and the time t5 represents the time at which the voltage detection circuit 460 monitors and judges the voltage Vc across the terminals of the main bank capacitor 430 following the time t4.

When the flash lamp 2 has illuminated, the voltage Vc across the terminals of the main bank capacitor 430 drops as shown by the solid line γ1 in FIG. 11, so that the voltage Vc becomes equal to the discharging stop voltage Vce at time t4. After this, the voltage Vc across the terminals of the main bank capacitor 430 stays at this discharging stop voltage Vce until the main bank capacitor 430 is charged again.

During this period, even if an illumination start signal is outputted to the trigger circuit 440, a trigger signal that may be outputted due to a defect in the trigger circuit 440 will be weak or no trigger signal will be outputted, so that no discharge current flows to the flash lamp 2 and illumination does not occur. In this case, the voltage Vc across the terminals of the main bank capacitor 430 will remain close to the charging stop voltage Vcs.

Also, if the comparator 56 outputs an illumination stop signal and the IGBT 450 is shorted out due to a defect, the flash lamp 2 will illuminate until the static energy that has accumulated in the main bank capacitor 430 has all been used up. In this case, the flash lamp 2 will illuminate for too long, so that the voltage Vc across the terminals of the main bank capacitor 430 drops below discharging stop voltage Vce, as shown by the broken line γ3 in FIG. 11.

The CPU 51 monitors the voltage Vc across the terminals of the main bank capacitor 430 at the time t5. When the voltage Vc across the terminals of the main bank capacitor 430 is equal to the discharging stop voltage Vce, the CPU 51 judges that the flash lamp 2 has illuminated properly, and returns to the main routine.

On the other hand, when the voltage Vc across the terminals of the main bank capacitor 430 is roughly equal to the charging stop voltage Vcs or is significantly less than the discharging stop voltage Vce, the CPU 51 judges that the flash lamp 2 has not illuminated properly or that the IGBT 450 is broken. The CPU 51 terminates the fixing procedure and has the display unit 53 inform that user, that there is a problem.

Figure 12A:
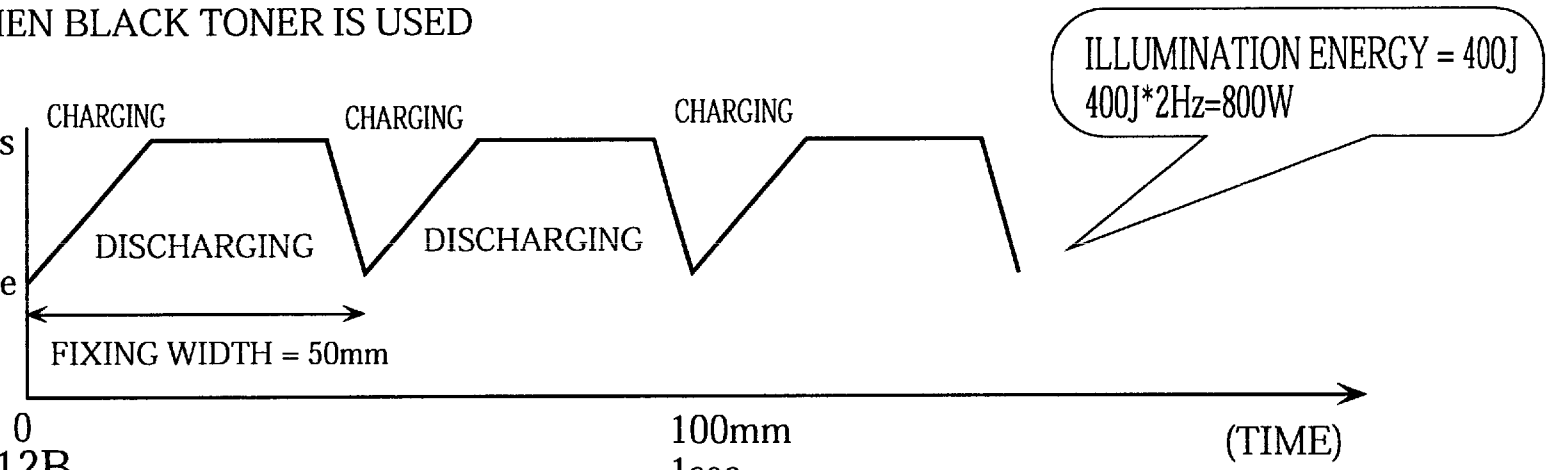
FIG. 12A shows the transition in the voltage Vc across the terminals of the main bank capacitor for the case where black toner is used and FIG. 12B shows the transition in the voltage Vc across the terminals of the main bank capacitor for the case where color toner is used.
Figure 12B:
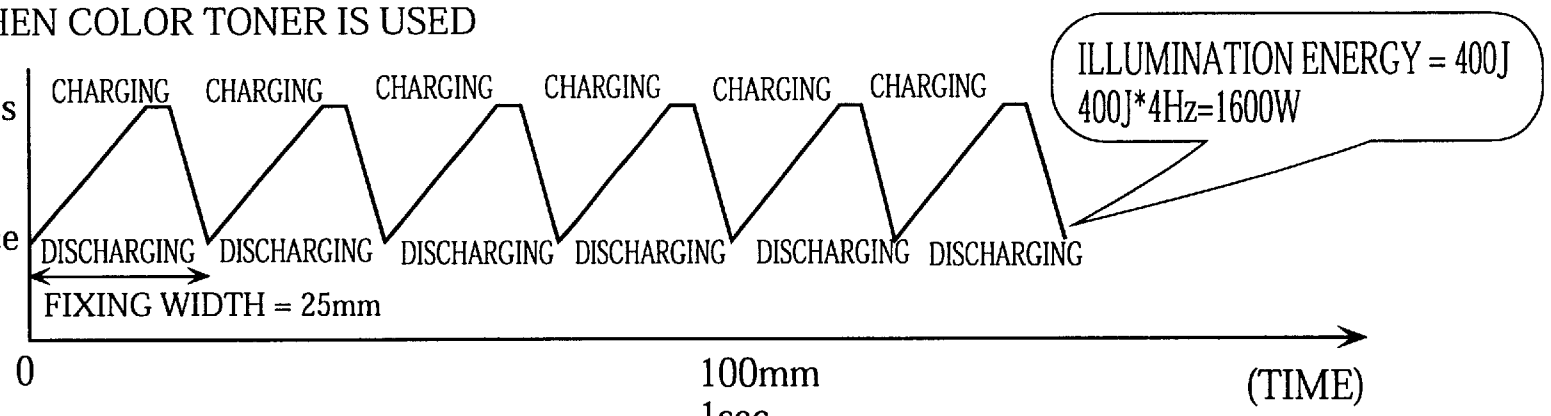

FIG. 12A and 12B show the changes in the voltage Vc across the terminals of the main bank capacitor 430 over time when the fixing procedure of steps S1 to S14 is performed. FIG. 12A shows the changes when a black toner image is fixed, while FIG. 12B shows the changes when a color image is fixed. Note that FIG. 12B also covers the case where a black image is superimposed on a color image.

The sheet S is transported at the same system speed (100 mm/s) when a black toner image or a color toner image is fixed. The light energy produced in one illumination of the flash lamp 2 is also 400J in either case. However, when a black toner image is being fixed, the fixing width is set at WK=50 mm and the cycle for the charging/discharging of the main bank capacitor 430 and the illumination of the flash lamp 2 is set at 0.5 seconds (2 Hz). On the otherhand, when a color toner image is being fixed, the fixing width is set at WR=25 mm and the cycle for the charging/discharging of the main bank capacitor 430 and the illumination of the flash lamp 2 is set at 0.25 seconds (4 Hz). As a result, the intensity of the light-energy produced by the illumination in one second is 400J*2 Hz800W when a black toner image is fixed and 400J*4 Hz=1600W when a color toner image is fixed.

Figure 13:
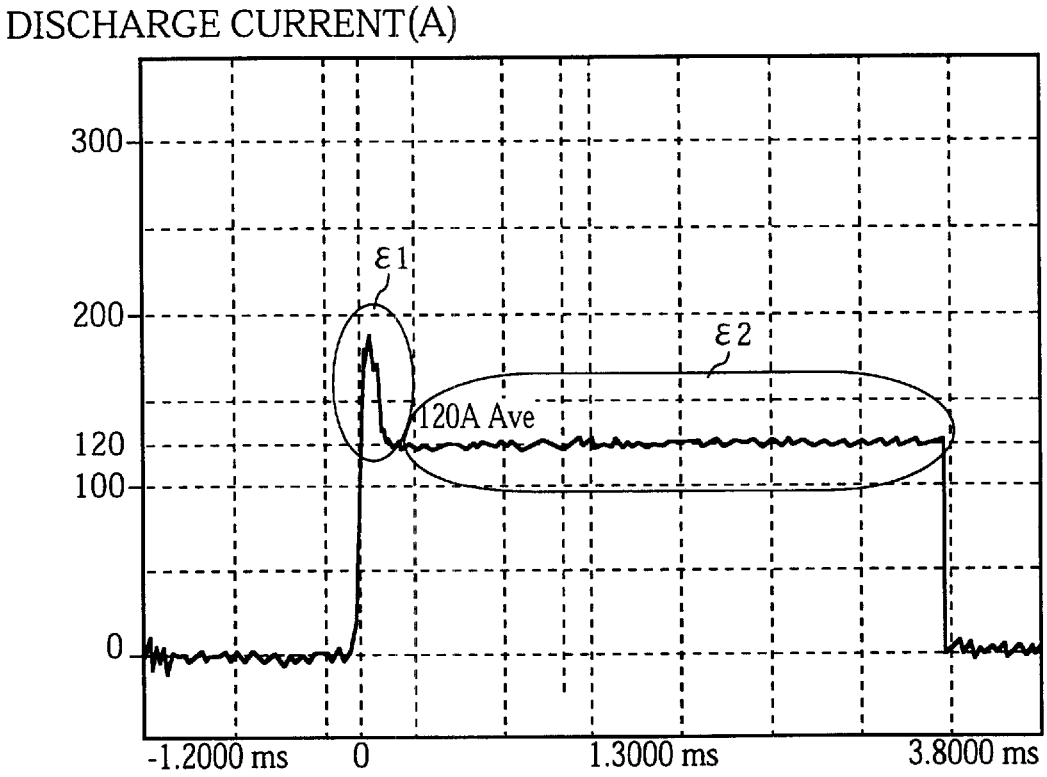
FIG. 13 shows the transition in the discharge voltage that flows through the flash lamp.

FIG. 13 shows the changes over time in the discharge current that flows through the flash lamp 2 during discharge.

Note that the circled area ϵ1 in FIG. 13 shows a period that corresponds to the pulse width of the trigger signal, while the, circled area ϵ2 shows the fixed current region.

As shown in FIG. 13, the trigger circuit 440 of the flash-based fixing apparatus 1 of the present embodiment has a capacitor 442 with low capacitance, so that the pulse width and peak value of the trigger signal are small.

As a result, the peak current produced due to the trigger signal only flows for an instant (the part shown by the circled area ϵ1). The peak value is suppressed to around 180A, meaning that there is very little sublimation of toner.

In the present embodiment, the main bank capacitor 430 has a large capacitance, such as 6250 $\mu$F. As a result, the voltage Vc across the terminals of the main bank capacitor 430 hardly decreases when the amount of static energy required for one illumination of the flash lamp 2 is discharged. At the same time, the charging stop voltage Vcs and discharging stop voltage Vce are set within a range of voltages within which the flash lamp 2 can be driven with a constant current, the charging stop voltage Vcs is set at 800 V which is much lower than in a conventional flash-based fixing apparatus, and the discharging stop voltage Vce is set at 716 V which is much higher than in a conventional flash-based fixing apparatus. The supply of current to the flash lamp 2 is also stopped as soon as the flash lamp 2 has produced the required amount of light energy for fixing toner.

As a result, a low and fairly constant current of around 120A flows to the flash lamp 2 from the end of the period of peak flow caused by the trigger signal to the point where the supply of current is stopped.

Note that the constant current is lower than in a conventional apparatus since it has been suppressed by the operational resistance of the IGBT 450. This means that even if the same amount of light energy is produced as in a conventional apparatus, this energy will be applied at a lower rate to the surface of a black toner image or color toner image and will be converted to heat energy over a longer period. As a result, the surface temperature of the black toner will rise slowly, so that the black toner will start to melt from its surface downwards without sublimation of the binder. The heat energy produced is efficiently transmitted downward into the toner.

In the case of color toner, the amount of infrared absorbing agent is suppressed to 50% of the amount that was conventionally used. In spite of this, the extended reaction time means that the infrared absorbing agent can react efficiently, and the resulting heat energy can be efficiently transferred into the particles of toner. The toner therefore completely melts and seeps into the fibers of the sheet S.

When the flash lamp 2 is extinguished, the heat energy that has accumulated in the toner particles is dissipated to the air, lowering the temperature of the toner particles and causing the toner particles to harden within the sheet S. In this way, the toner image is fixed to the sheet S. Sublimation of the toner particles, and the noise caused by such sublimation is greatly suppressed.

Even when a black toner image and one or more color toner images are formed on the same sheet, the black toner image is heated slowly and evenly, so that even if too much energy is applied; the temperature will not rise to a temperature where sublimation occurs. Experiments were performed and the amount of airborne particles caused by sublimation was measured for a conventional flash-based fixing apparatus and the flash-based fixing apparatus of the present invention. While 1.054 mg/m$^3$ of particles were produced by the conventional apparatus, only 0.095 mg/m$^3$ of particles were produced by the apparatus of the present invention. This confirms that the apparatus of the present invention suppresses the generation of airborne particles to around one tenth of the amount generated by a conventional apparatus.

Another experiment was conducted to measure the operational noise of a printer equipped with a conventional flash-based fixing apparatus and a printer equipped with a flash-based fixing apparatus of the present invention. The former printer was measured as generating a maximum of 66.4 dB (A) while the latter printer generated a maximum of only 62.6 dB (A). This confirms that the present invention reduces the noise produced by the sublimation of toner by 3.8 dB (A) over a conventional flash-based fixing apparatus.

With the present embodiment, the discharge current that flows through the flash lamp 2 is roughly constant (i.e., the electrical waveform is roughly flat). This reduces the changes in voltage between the main electrodes 21 and 22 of the flash lamp 2 and changes in the voltage across to the main bank capacitor 430. As a result, there is the further effect of prolonged operational life for the flash lamp 2 and the main bank capacitor 430.

Note that in the present embodiment the comparator 56 is used to check whether the voltage Vc across the terminals of the main bank capacitor 430 has declined to the discharging stop voltage Vce, though as a modification, the voltage detection circuit 460 may monitor the voltage Vc and the CPU 51 may directly switch OFF the IGBT 450 when the voltage Vc reaches the discharging stop voltage Vce to manage the amount of light energy produced by the illumination.

Second Embodiment

In the first embodiment, the amount of light energy produced by the illumination is managed using the voltage Vc across the terminals of the main bank capacitor 430 and the discharging stop voltage Vce, though the following method is also possible. As described above, the discharge current is roughly constant during the discharge period of the flash lamp 2, so that there is a linear relationship between the light energy produced by the illumination and the illumination time. As a result, the light energy produced by the illumination can be managed using the illumination time of the flash lamp 2. In this case, an illumination time management table 543 such as that shown in FIG. 14 can be used in place of the illumination energy management table 541 in the ROM 54.

FIG. 14 shows an example of the content of the illumination time management table 543 stored in the ROM 54.

The illumination time management table 543 shows the relationship between the B/W information, the ID information, and the illumination time for one illumination of the flash lamp 2. As one example, when the B/W ratio is 1 to 6% and the ID is 0.8, the illumination energy management table 541 shows that, the flash lamp 2 should be illuminated for 3.5 msec from the start of illumination to the extinguishing of the flash lamp 2 to fix a black toner image.

When the illumination time management table 543 is used, the CPU 51 has the timer 52 start counting the flash lamp 2 starts to illuminate. When the illumination time obtained using the illumination time management table 543 has passed, the CPU 51 may switch OFF the IGBT 450 directly. In this embodiment, an optimal illumination time can be obtained from the amount of toner to be fixed (expressed using the B/W information and ID information) using the illumination time management table 543. This results in a great decrease in the sublimation of toner and in the noise that accompanies the sublimation of toner when fixing a toner image.

Third Embodiment

Figure 15:
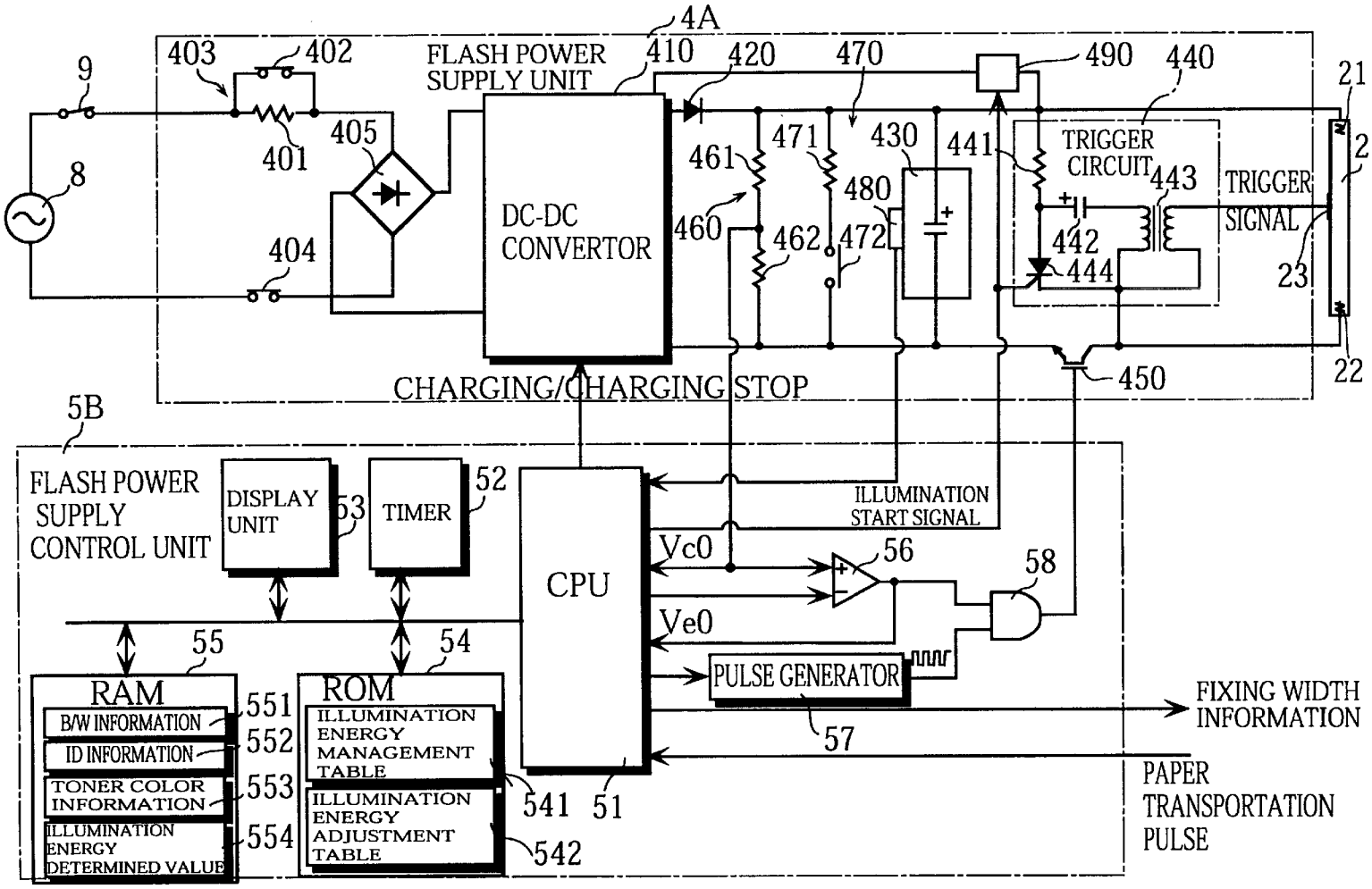
FIG. 15 is a block diagram showing the circuit construction of the flash power supply unit, the flash powder supply control unit and the periphery in the third embodiment of the present invention.

FIG. 15 is a block circuit diagram showing the construction of the flash power supply unit 4A, the flash power supply control unit 5A, and the peripheral components in a third embodiment of the present invention. Components that are the same as in the first embodiment have been given the same reference numerals and are not explained.

In the flash power supply control unit 5A of the first embodiment, the output of the comparator 56 is inputted into the IGBT 450. In this case, the discharge current that flows through the flash lamp 2 is determined exclusively by the impedance characteristics of the flash lamp 2 and the charging voltage of the main bank capacitor 430. This means that flexible control of the discharge current is not possible.

The flash power supply control unit 5B of this third embodiment includes a pulse generator 57 and an AND gate 58. The pulse generator 57 outputs a pulse signal with a predetermined frequency (such as a 100 kHz signal with a 50% duty ratio) in response to an indication from the CPU 51. The AND gate 58 takes a logical AND for the output of the pulse generator 57 and the output of the comparator 56 and so only outputs the output of the pulse generator 57 to the IGBT 450 when the output of the comparator 56 is the [H] signal.

When the voltage Vc across the terminals of the main bank capacitor 430 approaches the charging stop voltage Vcs used as the upper trip point, the comparator 56 outputs the [H] signal (illumination ready signal). As a result, the pulse signal produced by the pulse generator 57 is outputted to the IGBT 450, so that the IGBT 450 is repeatedly switched ON and OFF at high speed.

Figure 16:
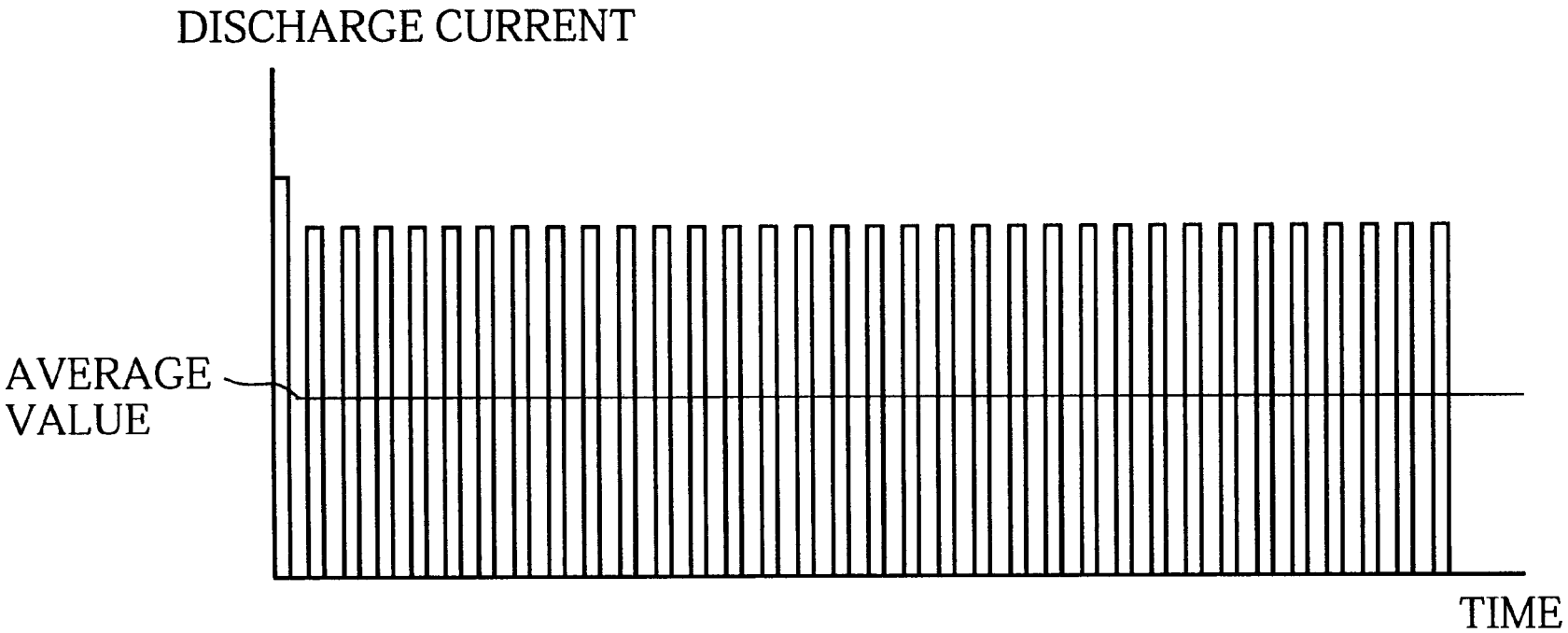
FIG. 16 shows the transition in the discharge current that flows in the third embodiment.

When the charging voltage of the main bank capacitor 430 has reached the charging stop voltage Vcs and the illumination start signal is inputted into the trigger circuit 440, the flash lamp 2 starts to illuminate. Since the IGBT 450 is switched ON and OFF at high speed, the discharge current that flows through the flash lamp 2 will be switched at high speed as shown in FIG. 16, so that the flash lamp 2 will momentarily illuminate when the IGBT 450 is ON. Note that once the flash lamp 2 illuminates, the gas inside the flash lamp 2 will remain active for a short while, so that the flash lamp 2 can be reilluminated when the IGBT 450 is momentarily ON without the further application of a trigger signal. Once sufficient current has been supplied for the flash lamp 2 to generate the desired amount of light energy, the voltage Vc across the terminals of the main bank capacitor 430 drops to the discharging stop voltage Vce, so that the comparator 56 outputs the [L] signal. As a result, the IGBT 450 is switched OFF, and the flash lamp 2 is extinguished.

During the illumination period of the flash lamp 2, the IGBT 450 is switched at high speed, the pulse width of the trigger signal will also become short, and the discharge current will become more even. As a result, 15 there is less dependence on the characteristics of the flash lamp 2 and the charging voltage of the main bank capacitor 430. Compared to the first embodiment, control is performed so that the discharge current is halved (on average) and the illumination time is doubled, thereby halving the discharge energy applied per unit time. In this way, the illumination of the flash lamp 2 can be controlled more flexibly. This third embodiment states that the duty ratio is fixed at 50%, though the CPU 51 may indicate a different duty ratio to the pulse generator 57, with the pulse generator 57 thereafter outputted a pulse signal with the, indicated duty ratio. The discharge current that flows through the flash lamp 2 changes in accordance with this duty ratio, so that highly flexible control can be performed.

Fourth Embodiment

In the third embodiment, pulse control is performed to switch the discharge current, but the light energy produced by the illumination is managed using the voltage Vc across the terminals of the main bank capacitor 430 and the discharging stop voltage Vce.

When the discharge current is switched using pulse control and, for example, the duty ratio of the switching pulse is 50%, an almost constant discharge current (average discharge current, to be precise) flows through the flash lamp 2 during the illumination period, so that the amount of light energy produced by the illumination is directly proportional to the number-of-illuminations. Using this relationship, the light energy produced by the flash lamp 2 can be managed by controlling the number-of-illuminations. In this case, the number-of-illuminations management table 544 shown in FIG. 17 can be used in place of the illumination energy management table 541 in the ROM 54.

FIG. 17 shows an example of the content of the number-of-illuminations management table 544 that is stored in the ROM 54.

The number-of-illuminations management table 544 shows the relationship between the B/W information, the ID information and the number of pulsed illuminations made by the flash lamp 2 in a single illumination operation. As one example, when the B/W ratio is 1 to 6%, the ID is 0.8, 250 pulsed illuminations of the flash lamp 2 are required to fix a black toner image.

When this kind of number-of-illuminations management table 544 is used, a counter region is provided in the RAM 55 and the CPU 51 sets "250 times" in the counter at the start of illumination by the flash lamp 2. Every time a pulse is outputted by the pulse generator 57, the CPU 51 decrements the count value of the counter by 1. When the count value reaches zero, the CPU 51 may switch OFF the IGBT 450 directly. In this embodiment too, the optimal number of pulsed illuminations can be obtained from the amount of toner to be fixed (expressed using the B/W information and ID information) using the number-of-illuminations management table 544. This results in a great decrease in the sublimation of toner and in the noise that accompanies the sublimation of toner when fixing a toner image.

Modifications

The present embodiment has been described by way of the embodiments given above, though it should be obvious that the invention is not limited to the details given therein. Several modifications are possible, with representative examples being given below.

Note that in the first to fourth embodiments, the same fixing width WR=25 mm is used for each kind of color toner, though this need not be the case. Different fixing widths can be used for toners of different colors.

As mentioned in the embodiments, increasing amounts of energy per unit area are required to fix blue, green, and red toner in that order. As examples, the fixing width may be set at 42 mm for blue toner and 38 mm for green toner. In this case the illumination cycle of the flash lamp 2 may also be determined in accordance with the fixing width.

In the, first to fourth embodiments, the fixing width land illumination period are changed depending on whether black toner or color toner is being fixed. However, the same fixing width and illumination period may be used regardless of whether black toner or color toner is being fixed, with the light energy produced by the illumination being doubled when a color toner is being fixed. In this case, the capacitance of the main bank capacitor 430 may be doubled.

Also in the first to fourth embodiments, blue, green, and red toners are used as the color toners, though other colors, such as yellow, cyan, and magenta, may be used.

The first to fourth embodiments describe the case where black images are formed using a toner that is fixed using around 1.9J/cm$^2$ of light energy perunit area, though a different black toner may be used. In such case, the light energy produced by the illumination, the fixing width, the illumination period, etc. may be set in accordance with the black toner that is used. While the color toners are described as including 1 to 2% of infrared absorbing agent by weight, color toners with different amounts of infrared absorbing agent may be used. The light energy produced by the illumination, the fixing width, the illumination period, etc. may be set in accordance with the toner used.

The first to fourth embodiments are described as including an IGBT 450, though a switching element such as a FET may be used instead.

The first to fourth embodiments state that the flash-based fixing apparatus is used in a laser printer, though the flash-based fixing apparatus may instead be used in a copier, a fax machine, a micro reader/printer, or an image forming apparatus that combines the functions of any of these.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A flash-based fixing apparatus for fixing toner on a substrate using energy of illumination, comprising:

a flash lamp drawing an approximately constant current upon an application of a voltage within a predetermined range;

a power supply unit for supplying power to the flash lamp so that the flash lamp illuminates; and a control unit having the power supply unit keep a voltage applied across the flash lamp within the predetermined range during illumination.

2. A flash-based fixing apparatus according to claim 1, wherein the control unit includes a timer for measuring time starting from when the flash lamp illuminates, and the control unit controls the power supply unit to stop supplying power to the flash lamp when the time measured by the timer becomes equal to a predetermined period.

3. A flash-based fixing apparatus for fixing toner on a substrate using energy of illumination, comprising:

a flash lamp drawing an approximately constant current upon an application of a voltage within a predetermined range;

a power supply unit for supplying power to the flash lamp so that the flash lamp illuminates, said power supply unit including a direct current power supply for supplying a direct current and a capacitor with a capacitance for accumulating an amount of static energy that exceeds an amount of energy for one illumination of the flash lamp, the capacitor being charged by the direct current supplied by the direct current power supply and supplying a part of the accumulated static energy to the flash lamp via a discharge path; and a control unit having a direct current power supply control unit for controlling the direct current power supply to charge the capacitor until a voltage across terminals of the capacitor reaches a value within the predetermined range.

4. A flash-based fixing apparatus according to claim 3, wherein the power supply unit further includes a switch that is located on the discharge path and switches between a first state where the flash lamp is connected to the capacitor and a second state where the flash lamp is not connected to the capacitor, and the control unit further includes a first switch controlling unit for controlling the switch to switch to the first state at an illumination start time and to switch to the second state at an illumination end time.

5. A flash-based fixing apparatus according to claim 4, wherein the control unit further includes a second switch controlling unit for having the switch repeatedly switch between the first state and second state during a period from the illumination start time to the illumination end time.

6. A flash-based fixing apparatus according to claim 3, wherein the control unit further includes a detection unit for detecting a voltage across terminals of the capacitor during an illumination of the flash lamp, and the control unit controls the power supply to stop supplying power to the flash lamp when the voltage detected by the detection unit becomes equal to a predetermined value.

7. A flash-based fixing apparatus according to claim 6, wherein the control unit further includes:

a timer for measuring time starting from when the flash lamp illuminates; and a judging unit for judging, based on time measured by the timer and the voltage detected by the detection unit, whether a correct amount of energy has been supplied to the flash lamp.

8. A flash-based fixing apparatus according to claim 7, wherein the control unit further includes:

a notifying unit for notifying a user when the judging unit judges that the correct amount of energy has not been supplied.

9. A flash-based fixing apparatus according to claim 3, wherein the control unit further includes:

a timer for measuring time starting from when a charging of the capacitor commences;

a detection unit for detecting a voltage across terminals of the capacitor starting from when the charging of the capacitor commences; and a judging unit for judging whether the capacitor is normal by judging, when the timer has measured a predetermined period, whether the voltage detected by the detection unit is a predetermined value.

10. A flash-based fixing apparatus according to claim 3, wherein the control unit further includes:

a detection unit for detecting a temperature of the capacitor; and a judging unit for judging whether the capacitor is normal based on the temperature detected by the detection unit.

11. A flash-based fixing apparatus according to claim 1, wherein the toner includes an infrared absorbing agent.

12. A flash-based fixing apparatus according to claim 1, wherein the control unit determines how much energy is to be supplied to the flash lamp for illumination based on a factor relating to the toner.

13. A flash-based fixing apparatus according to claim 12, wherein the factor relating to the toner is an ability of the toner to absorb infrared radiation.

14. A flash-based fixing apparatus according to claim 12, wherein the factor relating to the toner is an amount of the toner on the substrate.

15. A flash-based fixing apparatus according to claim 12, wherein the factor relating to the toner is a color of the toner.

16. A flash-based fixing apparatus for fixing toner on a substrate using energy provided by an illumination of a flash lamp, comprising:

a power supply unit for supplying power to the flash lamp so that the flash lamp illuminates; and a control unit for controlling the power supply unit to supply power to the flash lamp in accordance with a condition that differs depending on a color of the toner fixed on the substrate.

17. A flash-based fixing apparatus according to claim 16, wherein the condition is the amount of light energy to be supplied for an illumination of the flash lamp, and the control unit controls the power supply, in accordance with the color of the toner, to supply the flash lamp with a current that is equivalent to either a first amount of energy or a second amount of energy that differs from the first amount of energy.

18. A flash-based fixing apparatus for fixing toner on a substrate using energy provided by an illumination of a flash lamp, comprising:

a power supply unit for supplying power to the flash lamp so that the flash lamp illuminates;

a control unit for controlling the power supply unit to supply power to the flash lamp in accordance with a factor relating to the toner fixed on the substrate;

an illumination width changing unit for changing a width, in a transportation direction of the substrate, of a part of the substrate exposed to light from the flash lamp between a first width and a second width that is narrower than the first width;

wherein the condition is a cycle for illumination of the flash lamp, and the control unit further includes an illumination width control unit for controlling the illumination width changing unit to switch between the first width and the second width depending on differences in the factor relating to the toner and an illumination cycle control unit for controlling the power supply unit to have the flash lamp illuminate with a first cycle when the illumination width is the first width and with a second cycle when the illumination width is the second width, the second cycle being shorter than the first cycle.

19. A flash-based fixing apparatus for fixing toner on a substrate using energy of illumination, comprising:

a flash lamp drawing an approximately constant current upon an application of a voltage within a predetermined range;

a power supply unit for supplying power to the flash lamp so that the flash lamp illuminates; and a control unit for controlling the power supply unit to supply power to the flash lamp in accordance with a factor relating to the toner fixed on the substrate, the control unit having the power supply unit keep a voltage applied across the flash lamp within the predetermined range during illumination.

20. A flash-based fixing apparatus according to claim 16, wherein the factor relating to the toner is a color of the toner.

* * * * *